US009625852B2

(12) United States Patent
Shimizu et al.

(10) Patent No.: US 9,625,852 B2
(45) Date of Patent: Apr. 18, 2017

(54) CLEANING UNIT, PROCESS CARTRIDGE AND IMAGE FORMING APPARATUS

(71) Applicant: CANON KABUSHIKI KAISHA, Tokyo (JP)

(72) Inventors: Hiroki Shimizu, Suntou-gun (JP); Susumu Nittani, Suntou-gun (JP); Keisuke Nomura, Suntou-gun (JP); Hideki Kakuta, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/048,267

(22) Filed: Feb. 19, 2016

(65) Prior Publication Data

US 2016/0170370 A1 Jun. 16, 2016

Related U.S. Application Data

(62) Division of application No. 14/037,896, filed on Sep. 26, 2013, now Pat. No. 9,304,444.

(30) Foreign Application Priority Data

Sep. 27, 2012 (JP) ..... 2012-214638
Sep. 28, 2012 (JP) ..... 2012-216922
Aug. 28, 2013 (JP) ..... 2013-176753

(51) Int. Cl.
*G03G 15/08* (2006.01)
*G03G 21/16* (2006.01)
(Continued)

(52) U.S. Cl.
CPC ..... *G03G 15/0817* (2013.01); *G03G 15/0898* (2013.01); *G03G 21/0029* (2013.01);
(Continued)

(58) Field of Classification Search
CPC ..... G03G 15/0898; G03G 15/0817; G03G 15/0942; G03G 21/1832; G03G 21/0029
See application file for complete search history.

(56) References Cited

U.S. PATENT DOCUMENTS 5,404,216 A 4/1995 Numagami et al.
7,751,743 B2 7/2010 Kamimura et al.
(Continued)

FOREIGN PATENT DOCUMENTS

JP 2001-51568 A 2/2001
JP 2010-2680 A 1/2010
JP 2011-27969 A 2/2011

*Primary Examiner* — David Gray
*Assistant Examiner* — Carla Therrien
(74) *Attorney, Agent, or Firm* — Fitzpatrick, Cell, Harper & Scinto

(57) ABSTRACT

A cleaning unit for an image forming apparatus includes a frame; a cleaning blade; a first seal sealing between the frame and the blade, provided by injection molding into the frame adjacent to an axial end; and a second seal between the frame and the drum, provided opposing to the free end portion adjacent to the axial end portion, and the second seal having a L-like configuration with projection extending in a direction crossing with the axial direction outwardly beyond an end surface of the blade, wherein the first seal includes a base portion provided at a position inside of the end surface and extending in the crossing direction and an extension extending from the base portion in the axial direction, the extension having a free end portion compressed by the projection to seal between the projection and the frame.

16 Claims, 28 Drawing Sheets

(51) Int. Cl.
*G03G 21/00* (2006.01)
*G03G 21/18* (2006.01)

(52) U.S. Cl.
CPC ..... *G03G 21/169* (2013.01); *G03G 21/1619* (2013.01); *G03G 21/1832* (2013.01)

(56) References Cited

U.S. PATENT DOCUMENTS

| | | | | |
|---|---|---|---|---|
| 2009/0245851 | A1 | 10/2009 | Hoshi et al. | |
| 2009/0317124 | A1 | 12/2009 | Iwamoto et al. | |
| 2011/0217640 | A1* | 9/2011 | Hashiba ..... | G03G 15/00 430/56 |
| 2012/0008974 | A1 | 1/2012 | Kawai et al. | |
| 2012/0163855 | A1 | 6/2012 | Seo et al. | |
| 2013/0121720 | A1 | 5/2013 | Hoshi et al. | |
| 2013/0251394 | A1 | 9/2013 | Akamatsu | |
| 2013/0287439 | A1 | 10/2013 | Chadani et al. | |
| 2014/0072326 | A1 | 3/2014 | Yamaguchi et al. | |
| 2014/0093270 | A1 | 4/2014 | Nonaka | |
| 2014/0093271 | A1 | 4/2014 | Hoshi | |
| 2014/0376953 | A1 | 12/2014 | Kakuta et al. | |
| 2015/0220020 | A1* | 8/2015 | Hayashi ..... | G03G 15/0817 399/102 |

* cited by examiner

CLEANING UNIT, PROCESS CARTRIDGE AND IMAGE FORMING APPARATUS

This is a divisional application of U.S. patent application Ser. No. 14/037,896, filed Sep. 26, 2013.

FIELD OF THE INVENTION AND RELATED ART

The present invention relates to a cleaning unit, a process cartridge equipped with a cleaning unit, and an image forming apparatus equipped with a cleaning unit.

Heretofore, an image forming apparatus such as a printer which uses an electrophotographic image forming method (electrophotographic process) formed an image by going through the following steps. First, it uniformly charges its electrophotographic photosensitive member (which hereafter will be referred to as photosensitive drum) as an image bearing member. Then, it forms an electrostatic image on the photosensitive drum by selectively exposing specific points of the uniformly charged area of the photosensitive drum. Then, it develops the electrostatic image on the photosensitive drum into a visible image (image formed of toner) with the use of toner as developer. Then, it transfers the toner image on the photosensitive drum onto recording medium such as a sheet of recording paper, plastic film, etc. Then, it fixes the toner image on the recording medium to the recording medium by the application of heat and pressure. Generally, an image forming apparatus such as the one described above needs to have its various processing means maintained. Thus, various methods for making it easier to maintain the processing means have been put to practical use. One such method is to dispose together a photosensitive drum, a charging means, a developing means, a cleaning means, etc., in a cartridge, that is, a process cartridge, which is removably installable in the main assembly of an image forming apparatus. This process cartridge system makes it possible to provide an image forming apparatus which is excellent in terms of usability.

A process cartridge is primarily made up of a development unit and a cleaning unit. The cleaning unit is made up of a photosensitive drum, a charge roller, a cleaning blade, and a cleaning unit frame. The charge roller is a roller for charging the photosensitive drum. The cleaning member is a member for scraping the toner remaining on the peripheral surface of the photosensitive drum, away from the photosensitive drum. The cleaning unit frame is a frame for supporting the photosensitive drum, charge roller, and cleaning member.

After the toner is scraped away from the photosensitive drum by the cleaning member, it is stored in a storage for the removed toner, with which the cleaning unit frame is provided. A cleaning unit such as the one described above, is provided with end seals which are disposed at the lengthwise ends of the cleaning member to prevent the removed toner from leaking and/or falling out of the cleaning unit frame. When a process cartridge is assembled, it is common practice to provide a gap between the end of the cleaning edge of the cleaning member, and the corresponding end of the end seal, because unless the gap is provided, as the photosensitive drum is attached to the cleaning unit frame, it comes into contact with the cleaning member and end seal, and deforms the cleaning member and end seal. More specifically, unless the gap is provided, as the photosensitive drum is attached to the cleaning unit frame, the end seal is made to run onto the cleaning member, by the photosensitive drum, having sometimes an unwanted effect upon the state of contact between the cleaning blade and photosensitive drum. As the state of contact between the cleaning blade and photosensitive drum degrades, the toner having been scraped away from the photosensitive drum is likely to cause such a problem that it leaks out of the cleaning unit and/or scatters onto an image.

On the other hand, if the gap between the cleaning member and end seal is excessively large, the removed toner passes between the lengthwise end of the cleaning member and the end of the corresponding end seal, and freely leaks out of the cleaning unit frame.

Thus, there have been proposed various methods for ensuring that the gap between the cleaning member and end seal is filled. One of them is disclosed in Japanese Laid-open Patent Application 2001-51568. According to this method, the cleaning unit is provided with an auxiliary cleaning member to ensure that the gap is filled. Another one is disclosed in Japanese Laid-open Patent Application 2011-27969, as a method for preventing the toner from passing between the cleaning member and end seal. According to this method, the cleaning unit is provided with an auxiliary seal, which is disposed between the rear surface of the cleaning member and the cleaning unit frame.

However, in the case of the structural arrangement disclosed in Japanese Laid-open Patent Application 2001-51568, a gap is provided between the cleaning member and end seal. Thus, in order to keep the cleaning unit sealed at its lengthwise ends, an auxiliary member has to be attached to the cleaning blade. Thus, this method increases a process cartridge in the number of steps required to assembly a process cartridge. Further, in the case of the structural arrangement disclosed in Japanese Laid-open Patent Application 2100-27969, an attempt made to increase a development unit in performance in terms of toner collection and toner storage, because of the increase in the length of the service life of a process cartridge, and/or the reduction in the particle diameter of developer, requires the auxiliary seal to be increased in size and/or complicated in shape, which in turn may make it complicated to assemble a process cartridge (cleaning unit).

SUMMARY OF THE INVENTION

Thus, the primary object of the present invention is to keep sealed a cleaning unit at the lengthwise ends of its cleaning blade without complicating the unit in structure.

According to an aspect of the present invention, there is provided a cleaning unit for an image forming apparatus, said cleaning unit comprising a frame; a cleaning blade having a free end portion contacting a rotatable image bearing member for removing a developer from a image bearing member; said frame comprising a developer accommodating portion for accommodating the developer removed by said cleaning blade; a first sealing member sealing between said frame and said cleaning blade to prevent leakage of the developer from said developer accommodating portion, said first sealing member being provided by injection molding into said frame adjacent to an axial end portion of said image bearing member; and a second sealing member sealing between said frame and said image bearing member to prevent leakage of the developer from said developer accommodating portion, said second sealing member being provided at a position opposing to the free end portion adjacent to the axial end portion, and said second sealing member having a L-like configuration with a projected portion extending in a direction crossing with the axial direction outwardly beyond an end surface of said cleaning blade with respect to the axial direction, wherein said first sealing member includes a base portion provided at a position inside of the end surface with respect to the axial direction and extending in the crossing direction and an extension extending from said base portion in the axial direction, said extension having a free end portion compressed by said projected portion to seal between said projected portion and said frame.

According to a further aspect of the present invention, there is provided a process cartridge detachably mountable to a main assembly of an image forming apparatus, said process cartridge comprising a rotatable image bearing member; a frame; a cleaning blade having a free end portion contacting said image bearing member for removing a developer from a image bearing member; said frame comprising a developer accommodating portion for accommodating the developer removed by said cleaning blade; a first sealing member sealing between said frame and said cleaning blade to prevent leakage of the developer from said developer accommodating portion, said first sealing member being provided by injection molding into said frame adjacent to an axial end portion of said image bearing member; and a second sealing member sealing between said frame and said image bearing member to prevent leakage of the developer from said developer accommodating portion, said second sealing member being provided at a position opposing to the free end portion adjacent to the axial end portion, and said second sealing member having a L-like configuration with a projected portion extending in a direction crossing with the axial direction outwardly beyond an end surface of said cleaning blade with respect to the axial direction, wherein said first sealing member includes a base portion provided at a position inside of the end surface with respect to the axial direction and extending in the crossing direction and an extension extending from said base portion in the axial direction, said extension having a free end portion compressed by said projected portion to seal between said projected portion and said frame.

According to a further aspect of the present invention, there is provided an image forming apparatus for forming an image on a recording material, said image forming apparatus comprising a rotatable image bearing member; a frame; a cleaning blade having a free end portion contacting said image bearing member for removing a developer from a image bearing member; said frame comprising a developer accommodating portion for accommodating the developer removed by said cleaning blade; a first sealing member sealing between said frame and said cleaning blade to prevent leakage of the developer from said developer accommodating portion, said first sealing member being provided by injection molding into said frame adjacent to an axial end portion of said image bearing member; and a second sealing member sealing between said frame and said image bearing member to prevent leakage of the developer from said developer accommodating portion, said second sealing member being provided at a position opposing to the free end portion adjacent to the axial end portion, and said second sealing member having a L-like configuration with a projected portion extending in a direction crossing with the axial direction outwardly beyond an end surface of said cleaning blade with respect to the axial direction, wherein said first sealing member includes a base portion provided at a position inside of the end surface with respect to the axial direction and extending in the crossing direction and an extension extending from said base portion in the axial direction, said extension having a free end portion compressed by said projected portion to seal between said projected portion and said frame.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, embodiments of the present invention are described with reference to the appended drawings. However, the following embodiments of the present invention are not intended to limit the present invention in scope in terms of the measurements, materials, and shapes of the structural components of an image forming apparatus, and also, the positional relationship among the structural components. That is, these properties are to be modified as necessary according to the structure of an image forming apparatus to which the present invention is applied, and the conditions under which the apparatus is operated.

Embodiment 1

<Structure of Image Forming Apparatus>

Figure 2:
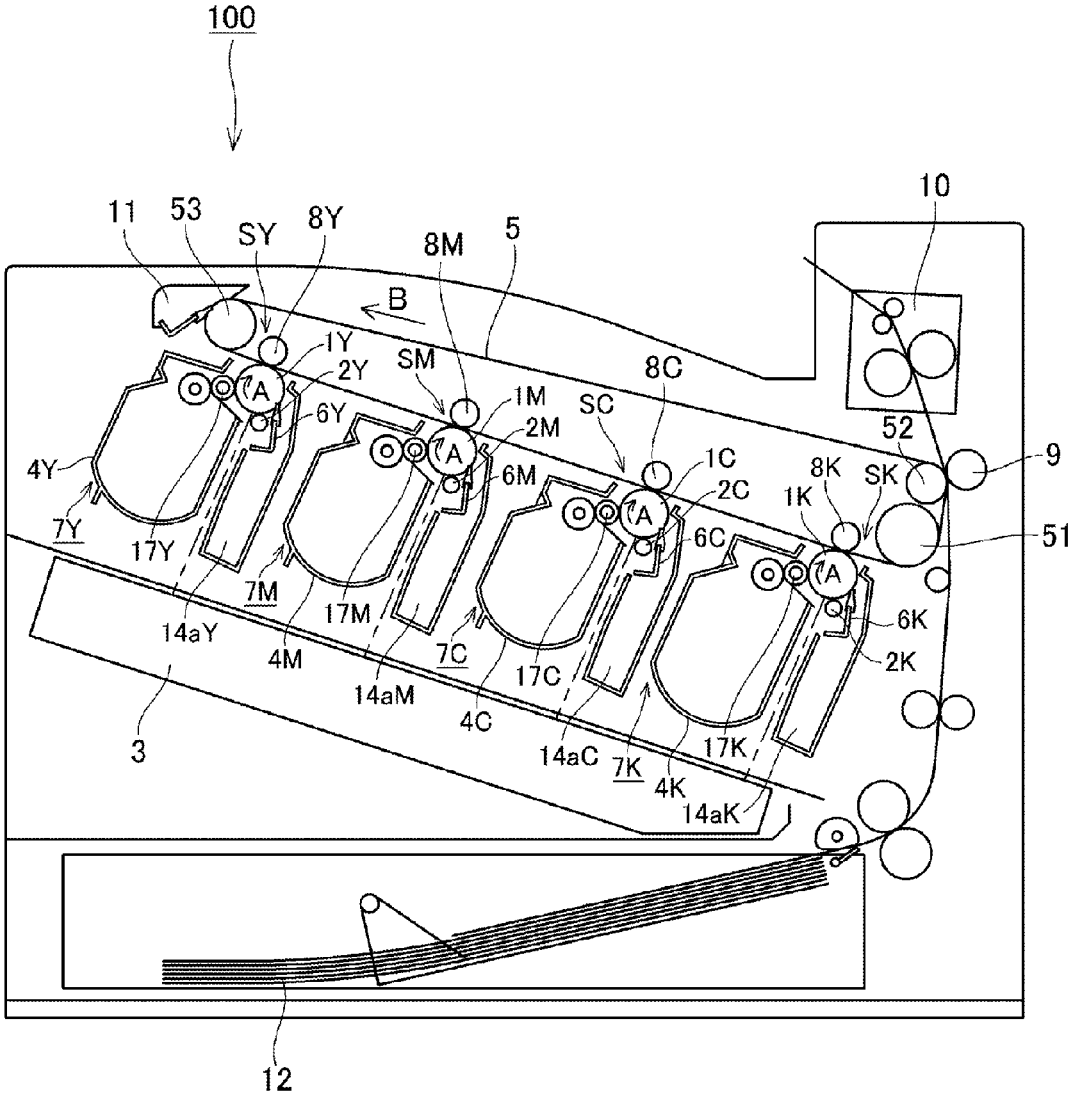
FIG. 2 is a schematic sectional view of the image forming apparatus in this first embodiment, and shows the general structure of the apparatus.

First, referring to FIG. 2, the electrophotographic image forming apparatus (which hereafter is referred to simply as image forming apparatus) 100 in this first embodiment of the present invention is described about its general structure. FIG. 2 is a schematic sectional view of the image forming apparatus in the first embodiment, and shows the general structure of the apparatus.

Referring to FIG. 2, the image forming apparatus 100 has multiple image formation stations, more specifically, the first, second, third, and fourth image formation stations SY, SM, SC and SK, which are for forming yellow (Y), magenta (M), cyan (C) and black (K) images, respectively. The first to fourth image formation stations in the first embodiment are practically the same in structure and operation, although they are different in the color of the image they form. Hereafter, therefore, they are described together, with no reference to the suffixes Y, M, C and K, unless they need to be differentiated.

The image forming apparatus 100 has four photosensitive drums 1, as image bearing members, which are aligned in tandem. The photosensitive drum 1 is rotatable in the direction indicated by an arrow mark A in the drawing. Each image formation station is provided with a charge roller 2 and a scanner unit (exposing device) 3, which are disposed in the adjacencies of the peripheral surface of the photosensitive drum 1.

The charge roller 2 is a charging means for uniformly charging the peripheral surface of the photosensitive drum 1. The scanner unit (exposing device) 3 is an exposing means for forming an electrostatic image (electrostatic latent image) on the peripheral surface of the photosensitive drum 1, by emitting a beam of laser light while modulating the beam according to the information of the image to be formed. The image forming station is also provided with a developing device (development unit, hereafter) 4, and a cleaning blade 6 as a cleaning means, which also are disposed in the adjacencies of the peripheral surface of the photosensitive drum 1.

The image forming apparatus 100 is also provided with an intermediary transfer belt 5 as an intermediary member which is disposed so that it opposes the four photosensitive drums 1 to transfer the toner images (images formed of developer) on the photosensitive drums 1, one for one, onto a sheet 12 of recording medium. In the first embodiment, nonmagnetic single-component developer, that is, toner, is used as the developer. Also in the first embodiment, the development unit 4 develops an electrostatic image on the photosensitive drum 1, by placing its development roller 17 in contact with the photosensitive drum 1.

In the first embodiment, the photosensitive drum 1, charge roller 2 which acts on the photosensitive drum 1, and cleaning device made up of the cleaning blade 6 and a toner storage 14*a* for storing the recovered transfer residual toner, are integrated in the form of a cleaning unit 13. Further, the development unit 4 and cleaning unit 13 are integrated in the form of a process cartridge 7, which is removably installable in the main assembly of the image forming apparatus 100, by way of an unshown cartridge installing-removing means, such as cartridge insertion-extraction guide, cartridge positioning member, etc., with which the main assembly of the image forming apparatus 100 is provided.

In the first embodiment, the four process cartridges 7 which correspond one for one to four primary colors, of which a multicolor image is formed by the image forming apparatus 100, are the same in shape, and contain yellow (Y), magenta (M), cyan (C) and black (K) toner, one for one. The intermediary transfer belt 5 is disposed so that it contacts all the photosensitive drums 1, and circularly moves in the direction indicated by an arrow mark B in FIG. 2. The intermediary transfer belt 5 is supported (suspended) by multiple belt supporting members (driver roller 51, secondary transfer roller opposing roller 52, and idler roller 53). There are disposed in parallel on the inward side of the loop which the intermediary transfer belt 5 forms, four primary transfer rollers 8 as primary transferring means, being positioned so that they oppose the four photosensitive drums 1 one for one. The apparatus main assembly is provided with a secondary transfer roller 9 as secondary transferring means, which is on the outward side of the intermediary transfer belt loop, being positioned so that it opposes the secondary transfer opposing roller 52.

The image forming operation of the image forming apparatus 100 in this embodiment is as follows: First, the peripheral surface of the photosensitive drum 1 is uniformly charged by the charge roller 2. Then, the uniformly charged portion of the peripheral surface of the photosensitive drum 1 is scanned by (exposed to) the beam of laser light emitted from the scanner unit 3 while being modulated according to the information of the image to be formed. Consequently, an electrostatic image, which reflects the information of the image to be formed, is formed on the peripheral surface of the photosensitive drum 1. Then, the electrostatic image on the photosensitive drum 1 is developed into a toner image (image formed of toner) by the development unit 4. Next, the toner image on the photosensitive drum 1 is transferred (primary transfer) onto the intermediary transfer belt 5 by the function of the primary transfer roller 8. Incidentally, when the image forming apparatus 100 is in the full-color mode, the above described process is sequentially repeated in the first to fourth image formation stations SY, SM, SC and SK, so that four toner images, different in color, are sequentially transferred (primary transfer) in layers onto the intermediary transfer belt 5. Meanwhile, a sheet 12 of recording medium is conveyed to the secondary transfer station in synchronism with the movement of the layered four toner images on the intermediary transfer belt 5. Then, the four toner images, different in color, on the intermediary transfer belt 5 are transferred together (secondary transfer) onto the sheet 12 of recording medium by the function of the secondary transfer roller 9.

After the transfer of the toner images onto the sheet 12 of recording medium (secondary transfer), the sheet 12 is conveyed to the fixing device 10, in which heat and pressure are applied to the sheet 12 and the toner images thereon, fixing thereby the toner images to the sheet 12. As for the primary transfer residual toner, that is, the toner remaining on the peripheral surface of the photosensitive drum 1 (image bearing member) after the secondary transfer, it is removed by the cleaning blade 6, and is recovered into the toner storage 14*a* for the removed toner. As for the secondary transfer residual toner, that is, the toner remaining on the intermediary transfer belt 5 after the completion of the secondary transfer process, it is removed by an intermediary transfer belt cleaning device 11. Incidentally, not only can the image forming apparatus 100 form a monochromatic image with the use of one of the four image formation stations, but also, a multicolor image with the use of two or more of the four image formation stations.

<Structure of Process Cartridge>

Figure 3:
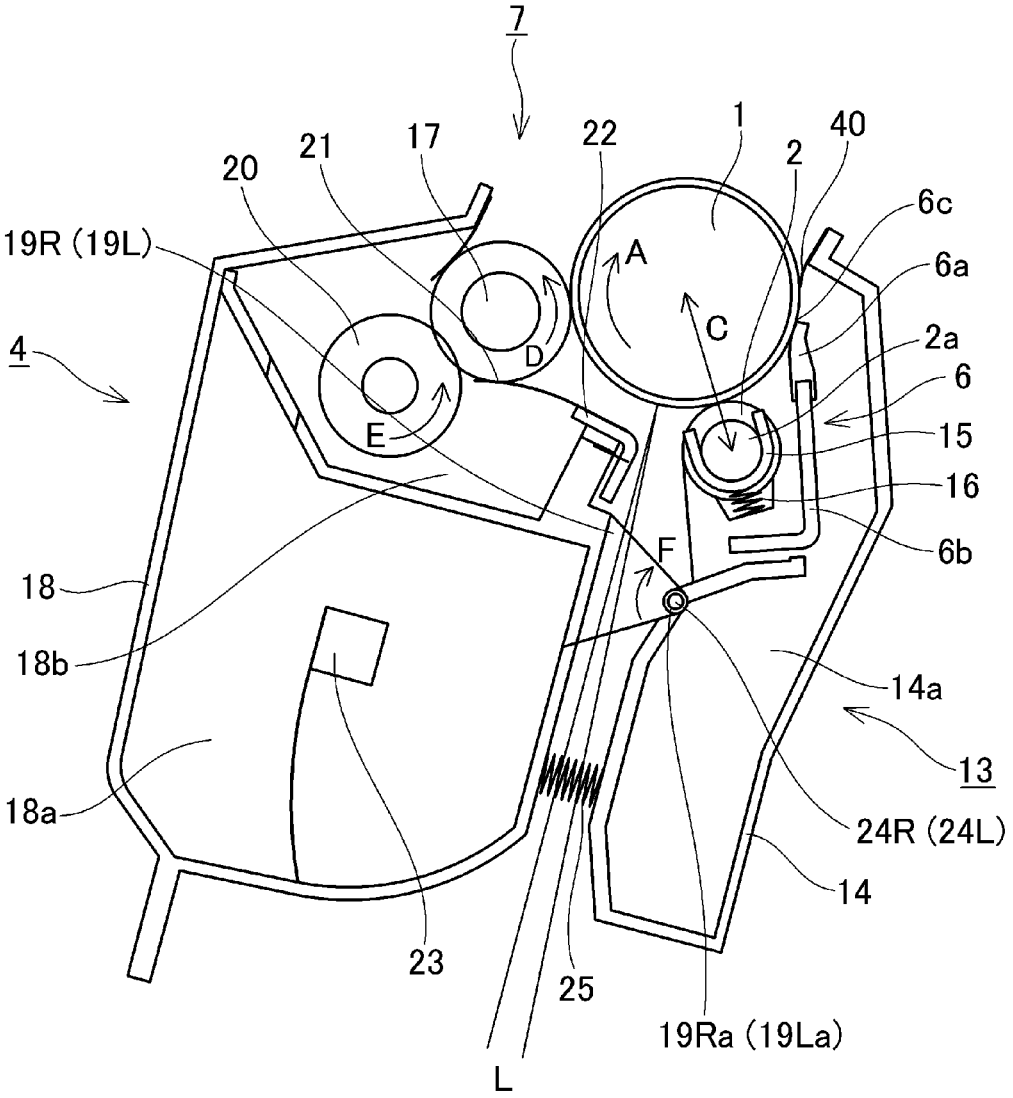
FIG. 3 is a schematic sectional view of the process cartridge in the first embodiment.

Next, referring to FIG. 3, the process cartridge 7, which is mountable in the image forming apparatus 100 in the first embodiment, is described about its general structure. FIG. 3 is a schematic sectional view of the process cartridge 7 when the photosensitive drum 1 and development roller 17 of the process cartridge 7 are in contact with the each other.

The development unit 4 has a development unit frame 18 which supports various elements in the development unit 4. More specifically, it has the development roller 17 as a developer bearing member which rotates in contact with the photosensitive drum 1 in the direction (counterclockwise direction) indicated by an arrow mark D in FIG. 3. The development roller 17 is rotatably supported by the development unit frame 18, by its ends in terms of its lengthwise direction (parallel to rotational axis of roller 17), with the placement of a pair of development roller bearings 19 (19R and 19L) between the lengthwise ends of the development roller 17 and development unit frame 18.

Further, the development unit 4 has a developer storage (toner storage chamber) 18*a*, and a development chamber 18*b* in which the development roller 17 is disposed. There are disposed a toner supply roller 20 and a development blade 21, in the development chamber 18*b*. The toner supply roller 20 is a developer supplying member, which rotates in contact with the development roller 17 in the direction indicated by an arrow mark E in FIG. 3. The development blade 21 is a developer regulating member for regulating the toner layer on the development roller 17. It is fixed to the development roller base 22, by being welded to the base 22 by the YAG (Ytrium Aluminum Garnet) laser, for example.

There is disposed in the toner storage chamber 18*a* of the development unit frame 18, a stirring member 23 which is for conveying the toner in the toner storage chamber 18*a* to the aforementioned toner supply roller 20 while stirring the toner. Further, the development unit 4 is connected to the cleaning unit 13, in such a manner that it is allowed to rotate about a pair of shafts 24 (24R and 24L) put through the holes 19Ra and 19La with which the bearings 19R and 19L are provided, respectively. Further, the development unit 4 is under the pressure generated by a pair of compression springs 25. Therefore, during an image forming operation, the development roller 17 is kept in contact with the photosensitive drum 1 by being pressed by the pair of compression springs 25 in the direction to rotationally move about the shaft 24 in the direction indicated by an arrow mark F.

Figure 4:
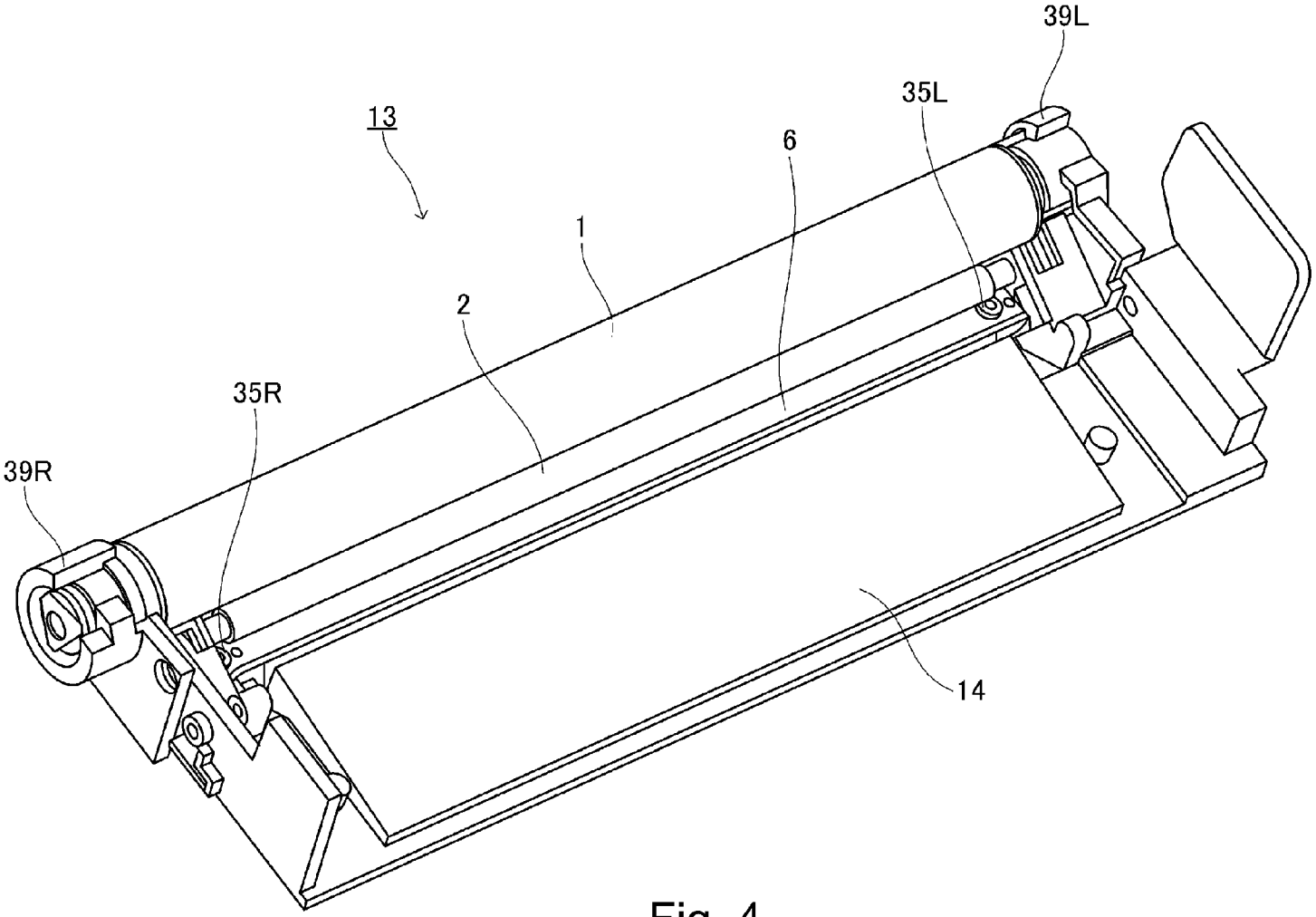
FIG. 4 is a perspective view of the cleaning unit in the first embodiment.
Figure 5:
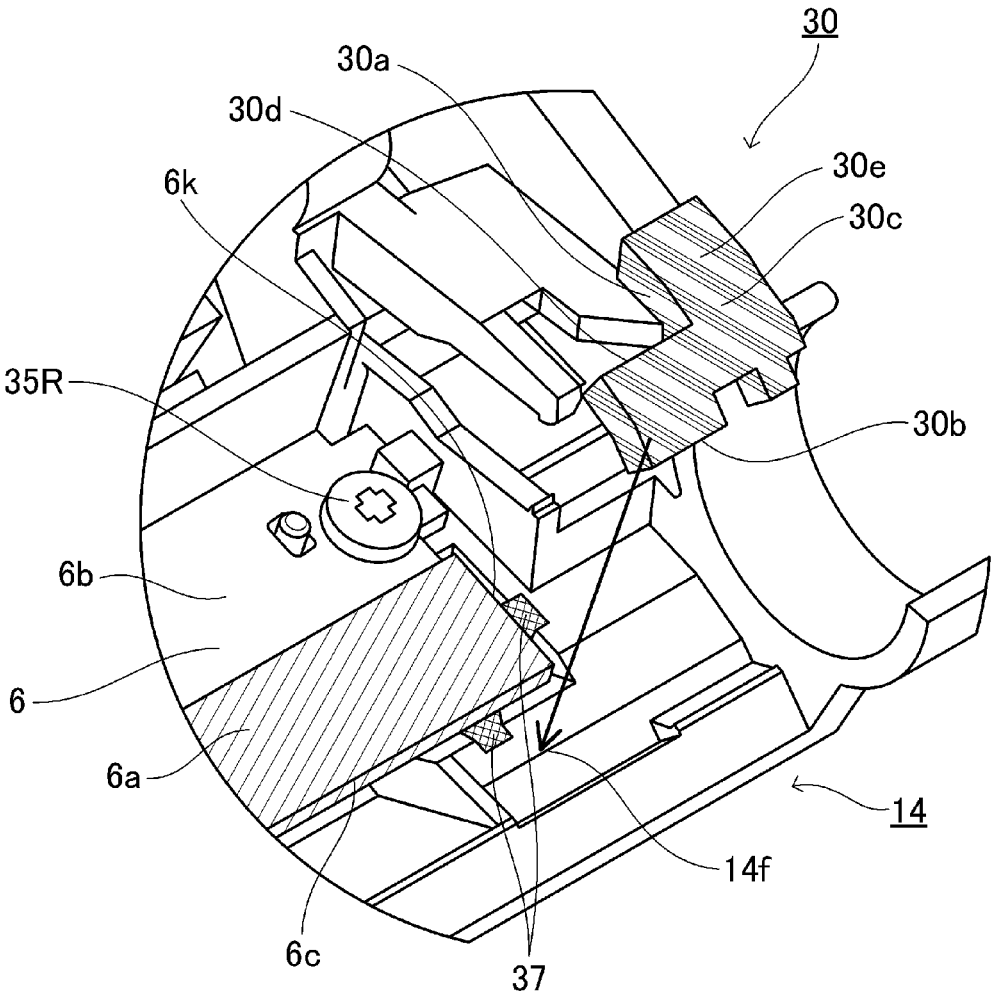
FIG. 5 is an enlarged perspective view of one of the lengthwise ends of the cleaning unit in the first embodiment, and shows the structural arrangement for keeping the cleaning unit sealed at the lengthwise ends of the cleaning unit.
Figure 6:
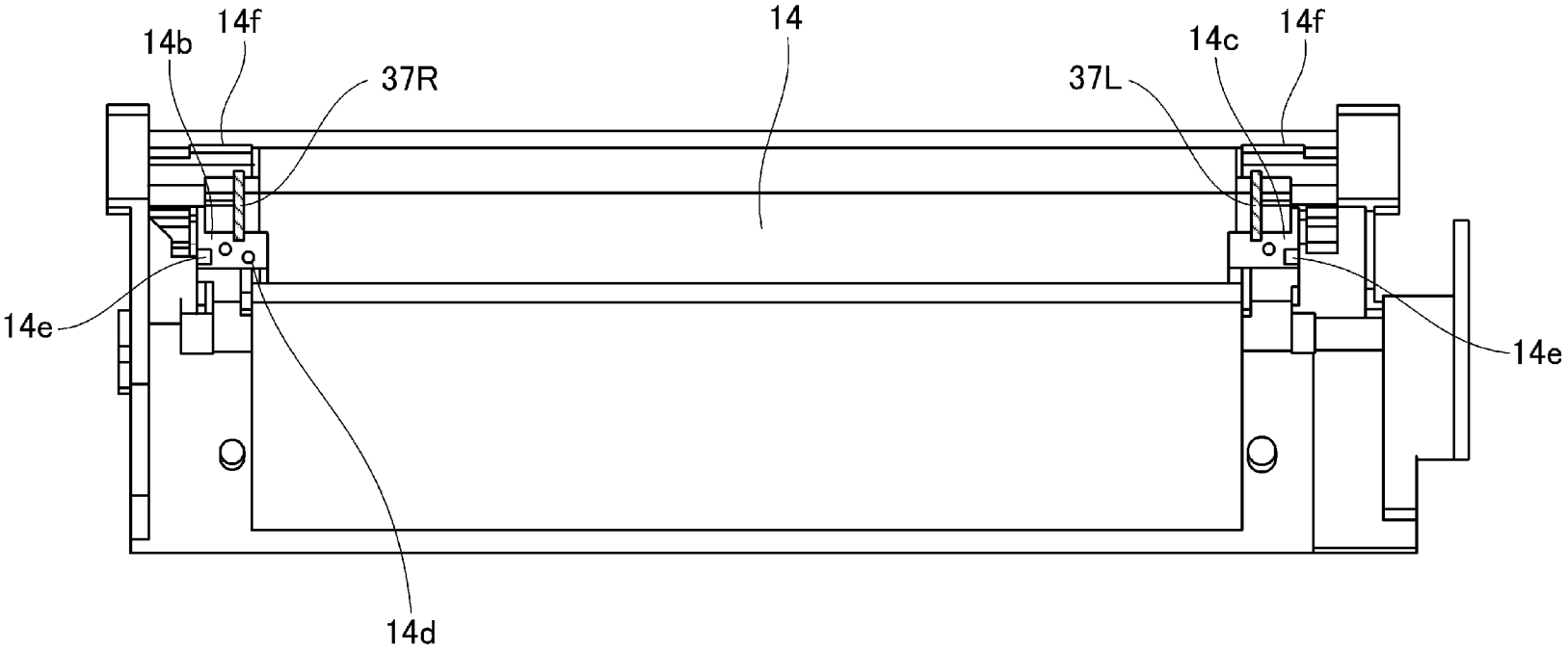
FIG. 6 is a plan view of the cleaning unit in the first embodiment, and shows the state of the cleaning unit immediately after the formation of the vertical seal.

Next, referring to FIGS. 3-6, the cleaning unit 13 in the first embodiment is described. FIG. 4 is a perspective view of the cleaning unit 13 in the first embodiment. FIG. 5 is an enlarged perspective view of one of the lengthwise end portions of the cleaning unit 13 in the first embodiment, and shows the structural arrangement for keeping sealed the lengthwise ends of the cleaning unit 13. FIG. 6 is a drawing for showing the state of the cleaning unit 13 immediately after the formation of the vertical seal in the first embodiment. The cleaning unit 13 has a cleaning unit frame 14, which is a frame by which various elements in the cleaning unit 13 are supported. It is to the cleaning unit frame 14 that the photosensitive drum 1 is attached, with the placement of a pair of bearings 39R and 39L between the photosensitive drum 1 and cleaning unit frame 14, so that the photosensitive drum 1 is rotatable in the direction indicated by the arrow mark A in FIG. 3. It is also to the cleaning unit frame 14 that the cleaning blade 6 is attached so that its cleaning edge remains in contact with the peripheral surface of the photosensitive drum 1.

The cleaning blade 6 is an integral combination of an elastic portion 6*a* for removing the toner remaining on the peripheral surface of the photosensitive drum 1, and a support plate 6*b* for supporting the elastic portion 6*a*. Referring to FIG. 4, the cleaning blade 6 is fixed to the cleaning unit frame 14 with a pair of small screws 35R and 35L at its lengthwise ends in terms of the direction parallel to the rotational axis of the photosensitive drum 1 (which hereafter may be referred to simply as lengthwise direction). Next, referring to FIG. 6, the cleaning unit frame 14 is provided with a pair of cleaning blade seating surfaces 14*b* and 14*c*, to which the cleaning blade 6 is fixed.

The transfer residual toner removed from the peripheral surface of the photosensitive drum 1 by the cleaning blade 6 falls in the direction of gravity through the space between the cleaning blade 6 and cleaning unit frame 14, and is stored in the toner storage 14*a* for the removed toner.

Referring to FIG. 3, the charge roller bearings 15 are attached to the cleaning unit frame 14 so that they align with each other in the direction parallel to the axial line of the charge roller 2 and the axial line of the photosensitive drum 1. More specifically, each charge roller bearing 15 is attached to the cleaning unit frame 14 in such a manner that it is allowed to move in the direction indicated by an arrow mark C in FIG. 3. The shaft 2*a* of the charge roller 2 is rotatably held by the charge roller bearings 15. Further, each charge roller bearing 15 is kept pressed toward the photosensitive drum 1 by a compression spring 16, as a pressure generating means.

Figure 1:
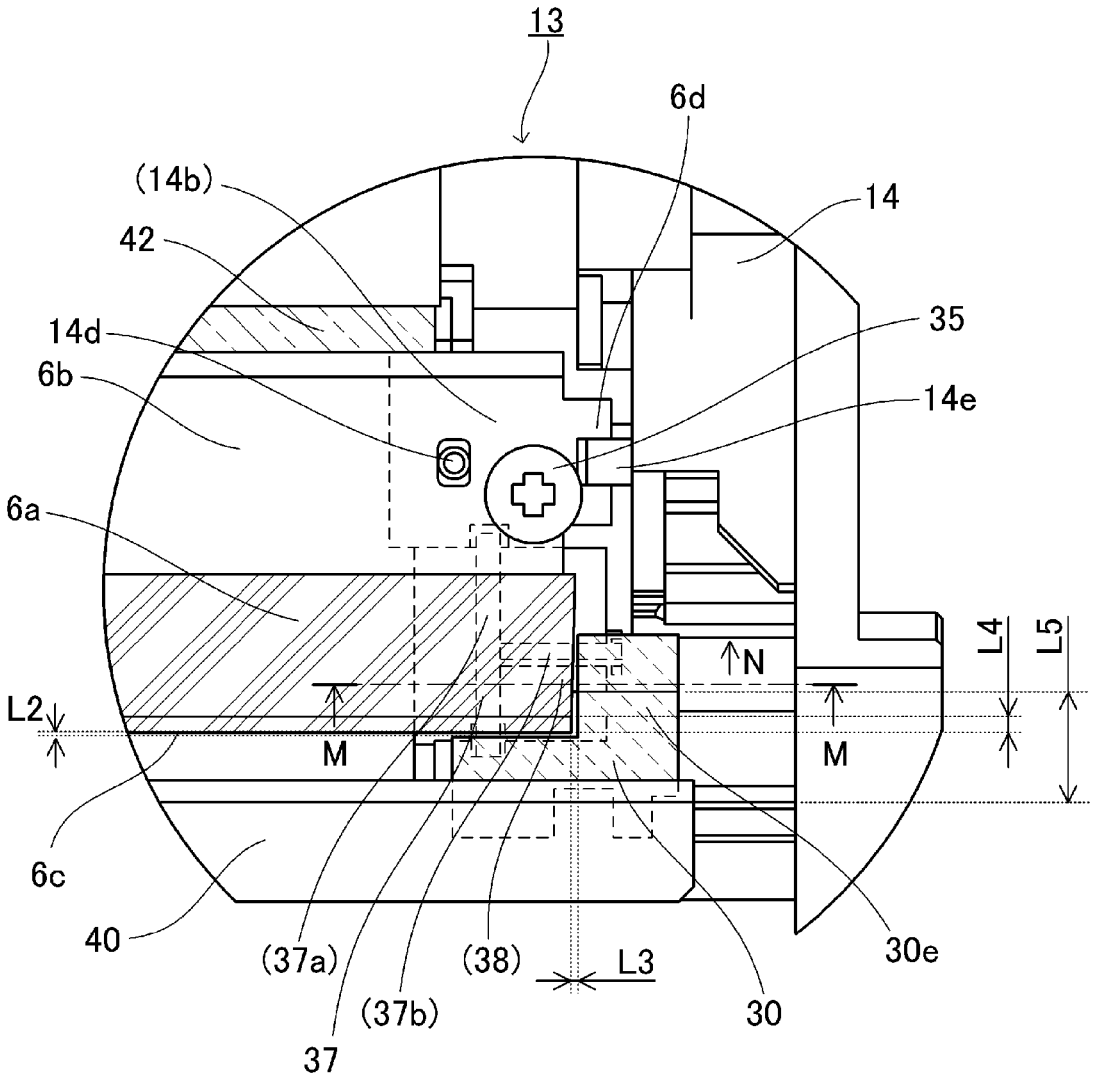
FIG. 1 is a drawing for describing the structural arrangement for keeping the cleaning unit sealed at the lengthwise ends of the cleaning unit, in the first embodiment of the present invention.
Figure 7:
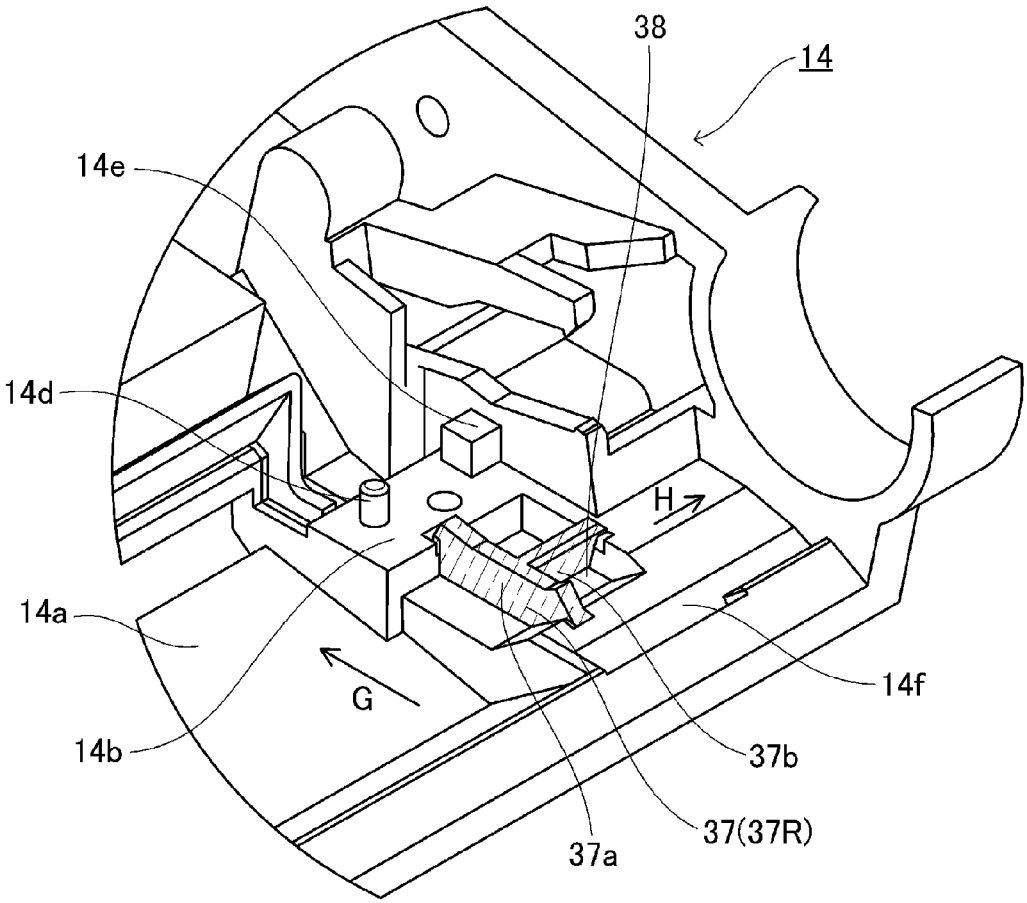
FIG. 7 is an enlarged perspective view of the vertical seal, and its adjacencies, in the first embodiment.
Figure 8:
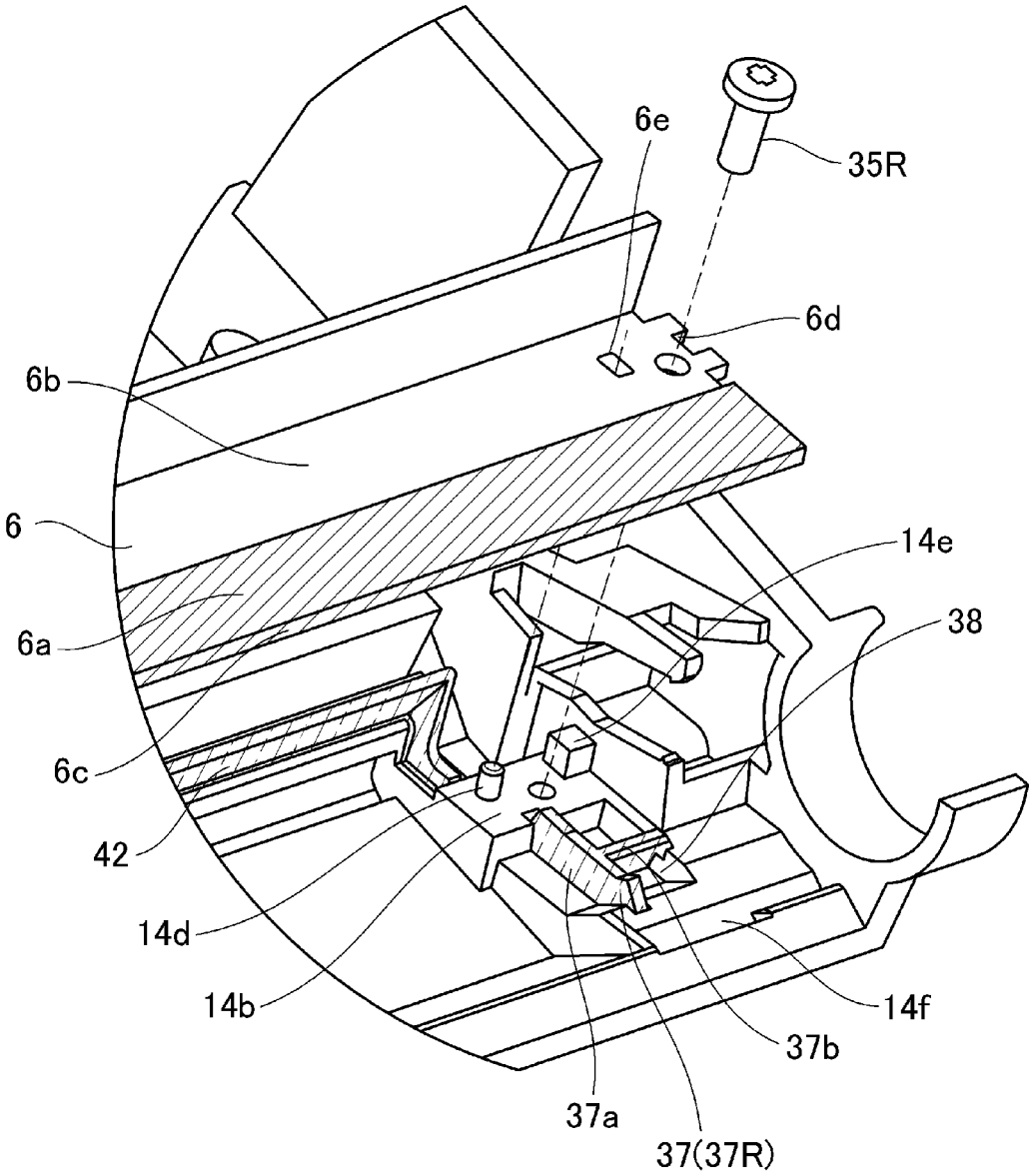
FIG. 8 is an enlarged perspective view of one of the lengthwise ends of the cleaning unit in the first embodiment, and shows the state of the lengthwise end immediately prior to the attachment of the cleaning blade to the cleaning unit frame.
Figure 9:
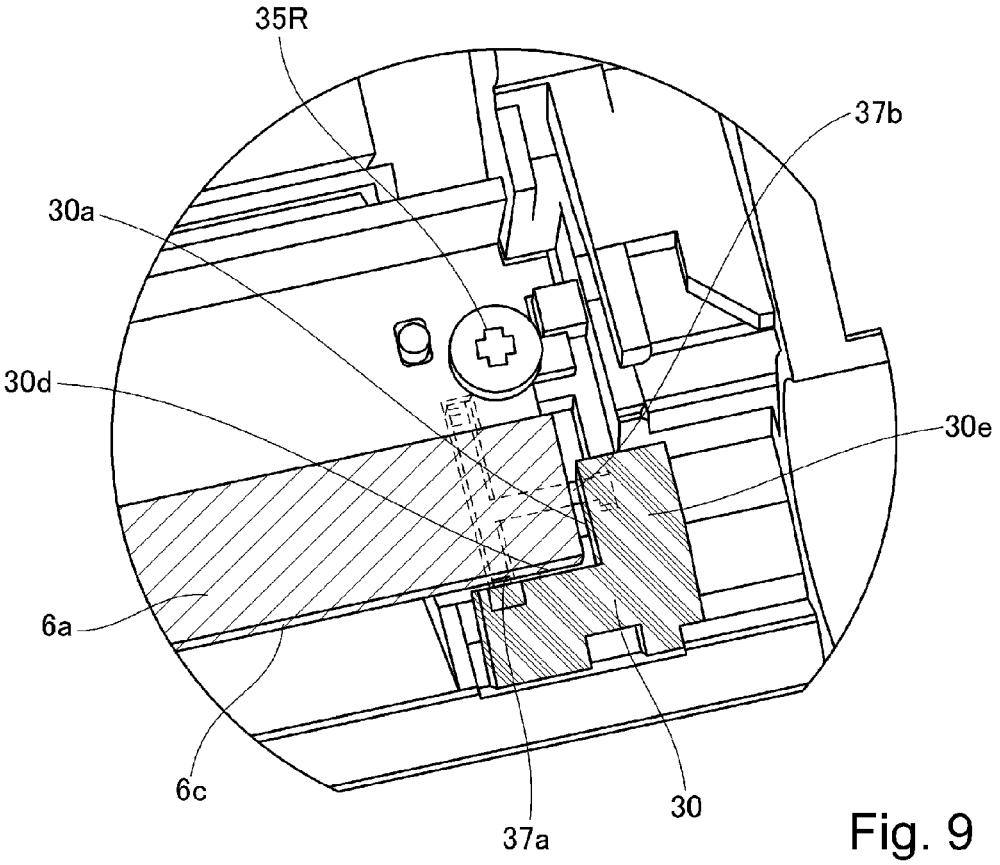
FIG. 9 is an enlarged perspective view of one of the lengthwise ends of the cleaning unit in the first embodiment, and shows the state of the lengthwise end after the attachment of the cleaning blade and end seal to the cleaning unit frame.
Figure 10:
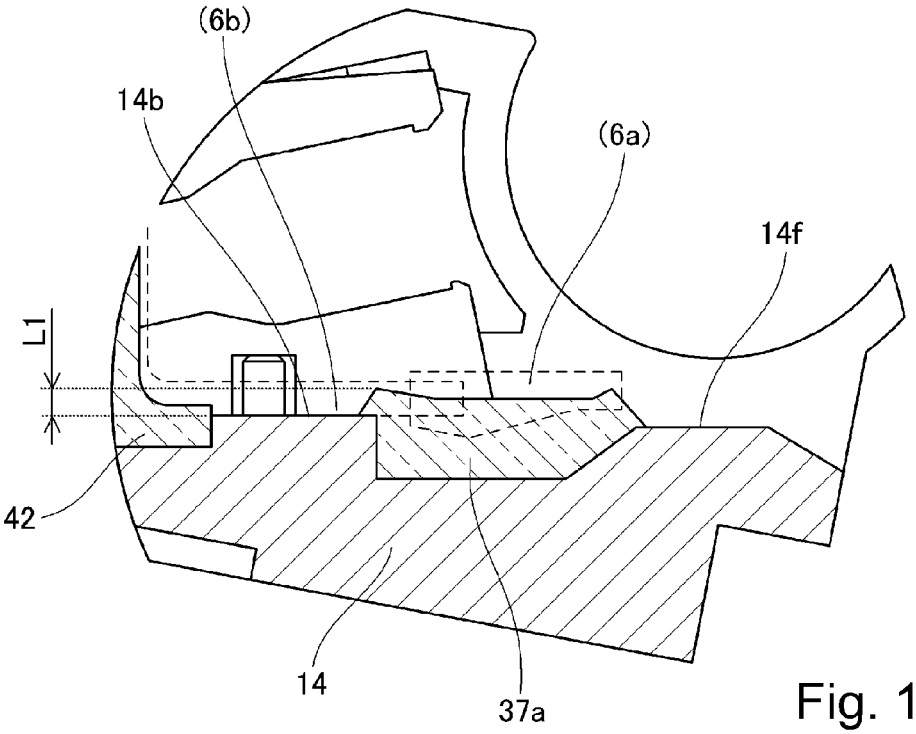
FIG. 10 is a schematic sectional view of the cleaning unit in the first embodiment, at a plane which coincides with the vertical seal.
Figure 11:
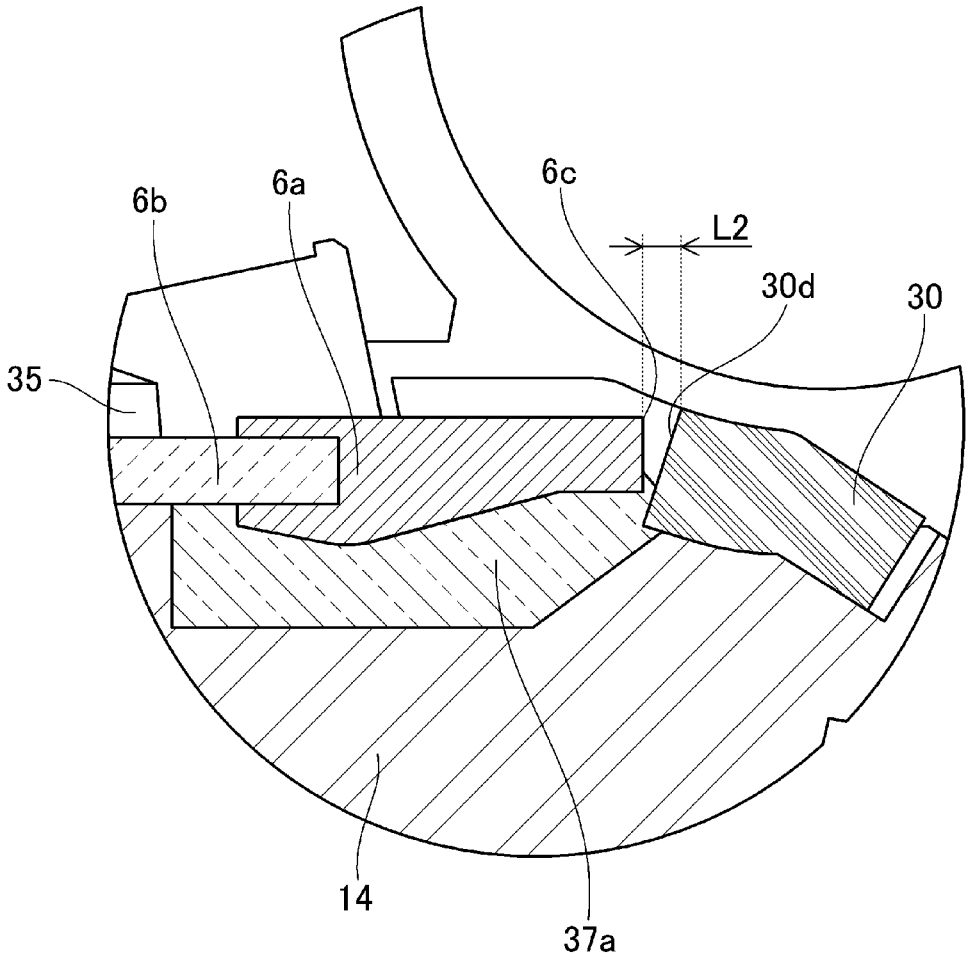
FIG. 11 is a schematic sectional view of the cleaning unit in the first embodiment, at a plane which coincides with the vertical seal, after the attachment of the cleaning blade and end seal.
Figure 12:
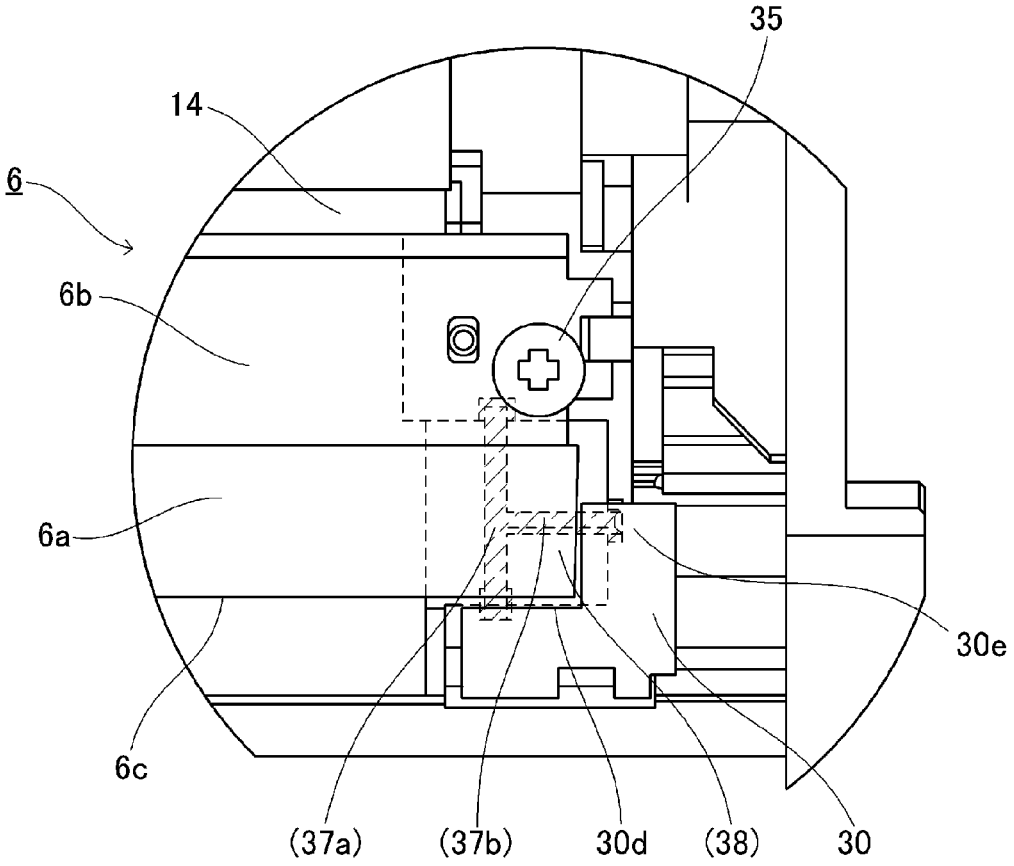
FIG. 12 is a plan view of one of the lengthwise ends of the cleaning unit in the first embodiment, and shows the structural arrangement for keeping the cleaning unit sealed at the lengthwise ends of the cleaning unit.

Next, referring to FIGS. 1, and 5-12, the structural arrangement for keeping the cleaning unit sealed in the first embodiment is described. FIG. 1 is a drawing for showing the structural arrangement for keeping the cleaning unit 4 sealed at its lengthwise ends, in the first embodiment. FIG. 7 is an enlarged perspective view of the vertical seal in the first embodiment. FIG. 8 is an enlarged perspective view of one of the lengthwise end portions of the cleaning unit 13, which is for describing how the cleaning blade 6 is attached to the cleaning unit frame 14. FIG. 9 is an enlarged perspective view of one of the lengthwise end portions of the cleaning unit 13 in the first embodiment, which is for showing the structural arrangement for keeping the cleaning unit sealed at the lengthwise ends. FIG. 10 is a schematic sectional view of the cleaning unit 13 in the first embodiment. FIG. 11 also is a schematic sectional view of the cleaning unit 13 in the first embodiment. FIG. 12 is a drawing for describing the structural arrangement for keeping the cleaning unit 13 sealed at its lengthwise ends, in the first embodiment. Hereafter, the relationship among the vertical seal 37, cleaning blade 6, and end seal 30, and the structural arrangement for preventing toner leakage, are described following the order in which these components are attached to the cleaning unit frame 14.

<Vertical Seal>

In the first embodiment, in order to prevent toner from leaking out of the cleaning unit frame 14 at the lengthwise ends of the cleaning blade 6, there is disposed the vertical seal 37 (as first sealing member) between the cleaning unit frame 14 and cleaning blade 6, remaining compressed by the cleaning unit frame 14 and cleaning blade 6. The vertical seal 37 is disposed at each of the lengthwise ends of the cleaning blade 6. In terms of the lengthwise direction, it is disposed on the inward side of the lengthwise end surface of the cleaning blade 6. Referring to FIG. 1, the vertical seal 37 is made up of the first and second rib-like portions 37*a* and 37*b*, respectively, which are molded together. The first rib-like portion 37*a* extends upstream from the cleaning blade seating surface 14*b* in terms of the rotational direction of the photosensitive drum 1. The second rib-like portion 37*b* extends in the direction parallel to the axial line of the shaft of the photosensitive drum 1.

First, the vertical seal 37 is formed as an integral part of the cleaning unit frame 14 by injection molding. Then, the cleaning blade 6 is placed on the blade seating surface 14*b* of the cleaning unit frame 14 shown in FIGS. 7 and 8. Then, the cleaning blade 6 is fixed to the cleaning unit frame 14 with small screws 35. Next, referring to FIG. 8, the cleaning unit frame 14 is provided with a boss 14*d* for precisely position the cleaning blade 6 relative to the cleaning unit frame 14 in terms of the lengthwise direction of the cleaning unit 13, whereas the supporting plate 6*b* of the cleaning blade 6 is provided with a hole 6*e*, which corresponds in position to the boss 14*d*. Also referring to FIG. 8, the cleaning unit frame 14 is provided with a square boss 14*e* for precisely positioning the cleaning blade 6 relative to the cleaning unit frame 14 in terms of the direction (widthwise direction) perpendicular to the lengthwise direction of the cleaning blade 6, whereas the cleaning blade 6 is provided with a recess 6*d* which corresponds in position to the square boss 14*e*.

Next, referring to FIG. 1, the vertical seal 37 is positioned so that it overlaps with the elastic portion 6*a* of the cleaning blade 6, at the lengthwise ends. Next, referring to FIG. 10, the vertical seal 37 is shaped so that after the formation of the vertical seal 37 on the cleaning unit frame 14, its first rib-like portion 37*a* extends by a preset amount (distance L1 in FIG. 10) from the cleaning blade seating surface 14*b* of the cleaning unit frame 14 in the direction perpendicular to the surface 14*b*, and also, so that it will extend by a preset distance from the position (indicated by broken line in FIG. 10) in which its top surface will be after the attachment of the cleaning blade 6 to the cleaning unit frame 14. Therefore, as the cleaning blade 6 is attached to the cleaning unit frame 14, the first rib-like portion 37*a* of the vertical seal 37 is compressed by the elastic portion 6*a* and elastic portion supporting portion 6*b* of the cleaning blade 6, being made to contact the cleaning blade 6 with no gap. Therefore, the toner removed from the peripheral surface of the photosensitive drum 1 is prevented from leaking out of the cleaning unit 13, through the area of contact between the cleaning blade 6 and vertical seal 37.

Next, referring to FIGS. 8 and 10, in this embodiment, the cleaning unit 13 is provided with a pair of seals 42 for preventing the toner removed from the peripheral surface of the photosensitive drum 1, from leaking from the cleaning unit 13 at the lengthwise ends of the area of contact between the cleaning unit frame 14 and cleaning blade 6. Like the vertical seal 37, each seal 42 is an elastic component formed as an integral part of the cleaning unit frame 14 by injection molding. Thus, it is compressed between the cleaning blade 6 and cleaning unit frame 14, being thereby made to remain in contact with the cleaning blade 6 with no gap. Therefore, it can prevent the removed toner from leaking from the cleaning unit 13 at the lengthwise ends of the area of contact between the cleaning unit frame 14 and cleaning blade 6.

<End Seal>

As described above, the toner remaining on the peripheral surface of the photosensitive drum 1 after the primary transfer during an image forming operation is scraped away by cleaning edge 6*c* of the cleaning blade 6 disposed in the counter direction to the rotational direction of the photosensitive drum 1. Then, it is stored in the toner storage 14*a* for the removed toner. Thus, it is possible that the toner scraped away from the peripheral surface of the photosensitive drum 1 will leak from the cleaning unit 13 through the area of contact between each of the lengthwise ends of the photosensitive drum 1 and the cleaning unit frame 14. Therefore, the cleaning unit 13 is provided with the pair of end seals 30, shown in FIG. 1, etc., which is for preventing the problem that the toner scraped away from the peripheral surface of the photosensitive drum 1 leaks from the cleaning unit 13 through the area of contact between each of the lengthwise ends of the photosensitive drum 1 and the cleaning unit frame 14.

The pair of end seals 30 as the second sealing members are disposed at the lengthwise ends of the cleaning unit frame 14, so that they correspond in position to the lengthwise end portions of cleaning edge 6*c* of the cleaning blade 6, one for one, and also, so that they remain compressed between the photosensitive drum 1 and cleaning unit frame 14. Each end seal 30 is provided with a protrusive portion 30*e* which is in the shape of a letter L, extending outward of the cleaning unit frame 14 beyond the lengthwise end surface 6*k* of the cleaning blade 6, and extending further from the cleaning edge portion of the cleaning blade 6 toward the base portion of the cleaning blade 6.

Next, referring to FIG. 5, the structure of the end seal 30 is described in detail. The above described protrusive portion 30*e* of the end seal 30 is provided with a lateral surface 30*a* for preventing the removed toner from leaking from the cleaning unit 13 at the lengthwise end surface 6*k* of the elastic portion 6*a* of the cleaning blade 6. Further, the rear side of the end seal 30 is provided with an adhesive layer 30*b* for bonding the end seal 30 to the cleaning unit frame 14. Further, the end seal 30 is provided with a surface 30*c* which contacts the peripheral surface of the photosensitive drum 1, and a surface 30*d* which is for preventing the removed toner from leaning from the cleaning unit 13 at the lengthwise end of the cleaning edge 6*c* of the cleaning blade 6.

The surface 30*c* of the end seal 30 is made up of an elastic substance such as piled fabric, felt, unwoven fabric, or the like. It contacts the peripheral surface of the photosensitive drum 1 in such a manner that it prevents the removed toner from leaking through the interface between itself and the peripheral surface of the photosensitive drum 1, while allowing the peripheral surface of the photosensitive drum 1 to slide on it. Incidentally, in some cases, the end seal 30 is provided with an intermediary layer, formed of foamed urethane or the like, for the adjustment of the contact pressure between the end seal 30 and photosensitive drum 1, in addition to the abovementioned layer, substances, etc. In the case of the end seal 30 in this embodiment, its surface by which it contacts the peripheral surface of the photosensitive drum 1 is made up of piled fabric. Further, it is provided with the intermediary layer made of foamed urethane, and a piece of two-sided adhesive tape, as the adhesive layer 30*b*, for fixing the end seal 30 to the cleaning unit frame 14.

Next, referring to FIGS. 1, 8 and 10, the end seal 30 is adhered to the end seal seating surface 14*f* of the cleaning unit frame 14, in such a manner that a preset amount (L2 in FIG. 1) of gap is provided between the surface 30*d* of the end seal 30, and the cleaning edge 6*c* of the elastic portion 6*a* of the cleaning blade 6, which contacts the photosensitive drum 1. In the first embodiment, the amount L2 of gap is set to be in a range of 0.1-0.5 mm. As the photosensitive drum 1 is attached to the cleaning unit frame 14, the elastic portion 6*a* of the cleaning blade 6, and the end seal 30 are deformed by the photosensitive drum 1, being thereby made to contact the peripheral surface of the photosensitive drum 1 with no gap. The gap L2 is provided for preventing the problem that as the end seal 30 is compressed by the photosensitive drum 1, it runs onto the elastic portion 6*c* of the cleaning blade 6. As for the other surface 30*a* of the end seal 30, the end seal 30 is adhered to the cleaning unit frame 14 so that a preset amount of gap (L3 in FIG. 1) is provided between the surface 30*a* of the end seal 30 and the elastic portion 6*a* of the cleaning blade 6. In this embodiment, the amount of the gap L3 is set to be in a range of 0-1.0 mm.

Next, the state of the cleaning unit 13 immediately after the attachment of the photosensitive drum 1 to the cleaning unit frame 14 is described. The photosensitive drum 1 is rotatably supported by the cleaning unit frame 14, with the placement of the drum bearings 39R and 39L between the lengthwise ends of the photosensitive drum 1, and the cleaning unit frame 14. As the photosensitive drum 1 is attached to the cleaning unit frame 14, the elastic portion 6*a* of the cleaning blade 6, and the end seal 30, are deformed by the photosensitive drum 1, being thereby made to contact the peripheral surface of the photosensitive drum 1 with no gap. More specifically, the peripheral surface of the photosensitive drum 1 and the elastic portion 6*a* of the cleaning blade 6, come into contact with each other in such a manner that the area of contact (L4 in FIG. 1) between the peripheral surface of the photosensitive drum 1 and elastic portion 6*a*, in terms of the direction perpendicular to the lengthwise direction, has a preset width (L4 in FIG. 1). Thus, as the photosensitive drum 1 rotates, the cleaning blade 6 scrapes away the transfer residual toner on the peripheral surface of the photosensitive drum 1. That is, the end seal 30 can prevent the problem that as the photosensitive drum 1 rotates, the transfer residual toner on the peripheral surface of the photosensitive drum 1 is scraped away by the cleaning blade 6, and the removed transfer toner leaks from the removed toner storage 14*a* of the cleaning unit frame 14. Further, the end seal 30 also contacts the peripheral surface of the photosensitive drum 1 by a preset width (L5 in FIG. 1), in such a manner that as the photosensitive drum 1 rotates, the end seal 30 allows the peripheral surface of the photosensitive drum 1 to slide on the end seal 30. Thus, the removed toner is prevented from leaking out of the cleaning unit 13 through the area of contact between the end seal 30 and the photosensitive drum.

(Characteristic Structural Features of Vertical Seal in First Embodiment)

Figure 13:
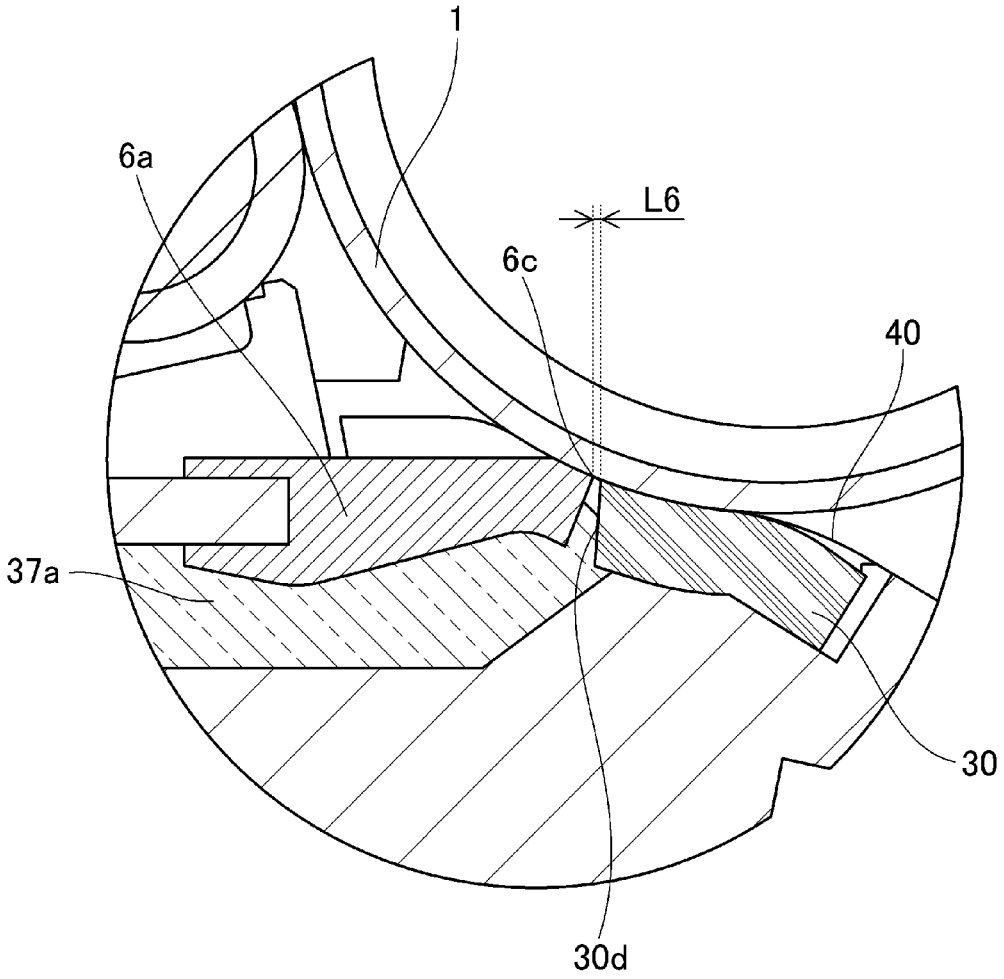
FIG. 13 is a schematic sectional view of one of the lengthwise ends of the cleaning unit in the first embodiment, at a plane which coincides with the vertical seal, after the attachment of the photosensitive drum to the cleaning unit frame.
Figure 14:
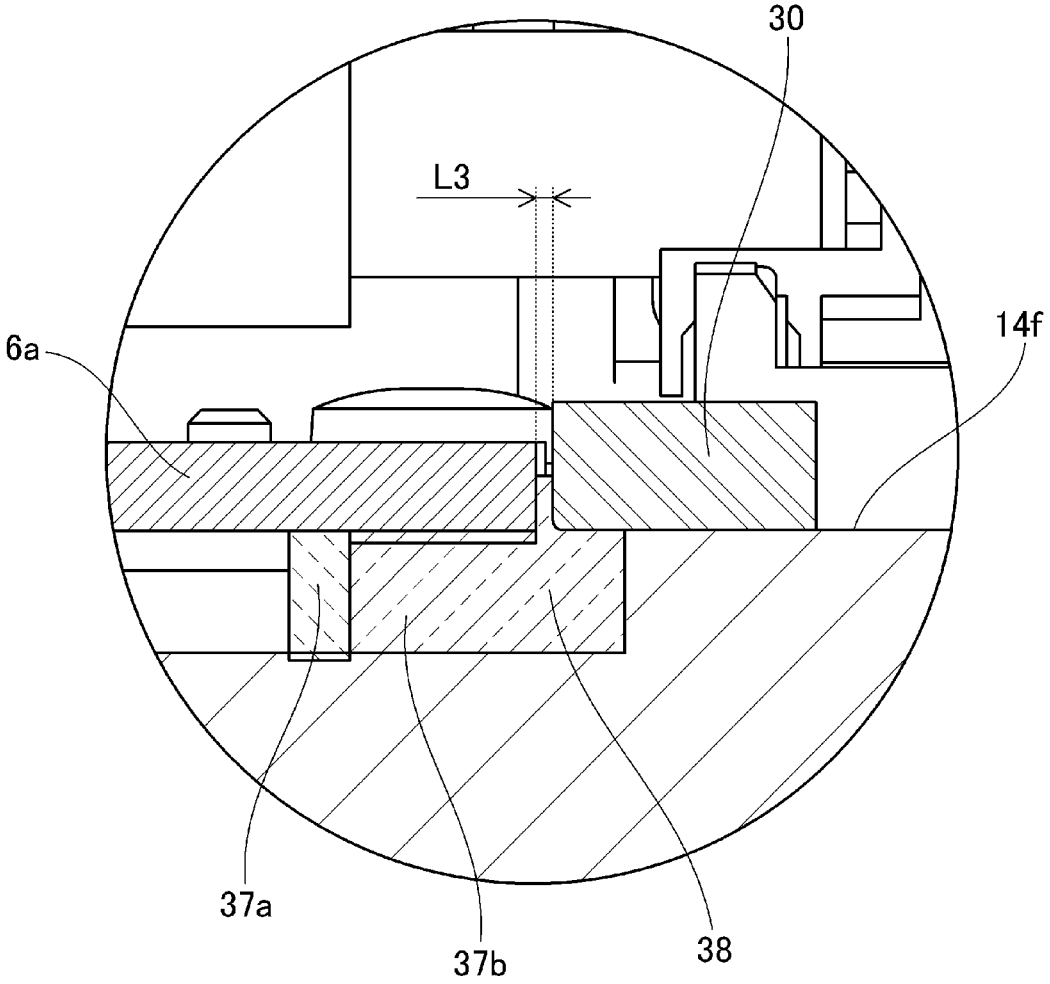
FIG. 14 is a plan view of one of the lengthwise ends of the cleaning unit in the first embodiment, and shows the structural arrangement for keeping the cleaning unit sealed at the lengthwise ends of the cleaning unit.

Next, referring to FIGS. 1, 13, 14, etc., the characteristic features of the structure of the cleaning unit 13 in the first embodiment are described. FIG. 13 is a schematic sectional view of the cleaning unit 13 in the first embodiment. It shows the structural arrangement for keeping the cleaning unit 13 sealed, in the first embodiment. FIG. 14 is a schematic sectional view of the cleaning unit 13 in the first embodiment, at a plane M-M in FIG. 1. It also shows the structural arrangement for keeping the cleaning unit 13 sealed. The vertical seal 37 in the first embodiment has the first rib-like portion 37*a*, as the main portion of the vertical seal 37, which extends upstream from the cleaning blade seating surface 14*b* of the cleaning unit frame 14 in terms of the rotational direction (indicated by arrow mark G in FIG. 7) of the photosensitive drum 1. The vertical seal 37 has also the second rib-like portion 37*b*, as an extension, which branches downstream, in terms of the rotational direction of the photosensitive drum 1, from the first rib-like portion 37*a*, and extends in the direction parallel to the direction of the axis of the shaft of the photosensitive drum 1. Each rib-like portion is formed as an integral part of the cleaning unit frame 14 by injection molding, being therefore airtightly in contact with the cleaning unit frame 14. Therefore, they can prevent toner from leaking from the cleaning unit 13 at the lengthwise end portions of the cleaning unit frame 14.

In the first embodiment, the vertical seal 37 is attached to the cleaning unit frame 14 so that the second rib-like portion 37*b* of the vertical seal 37 overlaps with both the elastic portion 6*a* of the cleaning blade 6, and the end seal 30. Therefore, as the cleaning blade 6 is attached to the cleaning unit frame 14, and the end seal 30 is adhered to the cleaning unit frame 14, the second rib-like portion 37*b* of the vertical seal 37 is compressed, whereby it is deformed in such a manner that it contacts the cleaning blade 6 and end seal 30 with no gap, and enters the gap L3 between the elastic portion a of the cleaning blade 6, and the end seal 30. That is, the second rib-like portion 37*b* fills the gap L3 between the elastic portion 6*a* and end seal 30.

Further, as described above, there is provided the gap L2 between the surface 30*d* of the end seal 30, and the cleaning edge 6*c* of the cleaning blade 6. This gap L2 is usually eliminated by the attachment of the photosensitive drum 1. However, it sometimes remains as a minute gap (L6), as shown in FIG. 13, making it possible for the removed toner, that is, the toner scraped away from the peripheral surface of the photosensitive drum 1 by the cleaning blade 6, to slip by the peripheral surface of the photosensitive drum 1 along the abovementioned minute gap (L6). Thus, in order to capture the removed toner to prevent the problem that the removed toner leaks out of the cleaning unit 13, the cleaning unit 13 is structured so that a toner trap 38 for the removed toner is formed by the elastic portion 6*a* of the cleaning blade 6, end seal 30, vertical seal 37, and cleaning unit frame 14, as shown in FIG. 14. That is, the second rib-like portion 37*b* contributes to the formation of the toner trap 38 as a space in which the toner having passed the area of contact between the cleaning edge 6*c* of the cleaning blade 6, and the end seal 30 is storable, on the outward side of the first rib-like portion 37*a* in terms of the lengthwise direction, in the cleaning unit frame 14.

The toner trap 38 traps the toner having slipped by the gap between the cleaning edge 6*c* of the cleaning blade 6, and the surface 30*d* of the end seal 30. Therefore, it has to be provided on the downstream side (indicated by arrow mark N) of the area of contact between the cleaning edge 6*c* of the cleaning blade 6 and the end seal 30. With the provision of the above described structural arrangement, even if the toner removed from the peripheral surface of the photosensitive drum 1 escapes outward by passing the area of contact between the cleaning edge 6*c* of the cleaning blade 6, and the surface 30*d* of the end seal 30, and is moved downstream in terms of the rotational direction of the photosensitive drum 1, by the rotation of the photosensitive drum 1, it is possible to capture the escaped toner by the toner trap 38. That is, the provision of the toner trap 38 further improves the cleaning unit 13 in terms of the sealing of the cleaning unit 4 to prevent the toner leakage at the lengthwise ends of the photosensitive drum 1.

In terms of the rotational direction of the photosensitive drum 1, the second rib-like portion 37*b* is disposed on the downstream side of the cleaning edge 6*c* of the cleaning blade 6. Therefore, the reaction force generated in the second rib-like portion 37*b* by the compression of the rib-like portion 37*b* by the cleaning blade 6 and end seal 30 does not affect the photosensitive drum 1. That is, it does not occur that the compressed second rib-like portion 37*b* increases the contact pressure between the cleaning blade 6 and photosensitive drum 1, and the contact pressure between the end seal 30 and photosensitive drum 1.

Further, the cleaning unit 13 is provided with a sheet 40, which is disposed on the upstream side of the cleaning blade 6 in terms of the rotational direction of the photosensitive drum 1 to guide the transfer residual toner on the photosensitive drum 1 into the toner storage 14*a* of the cleaning unit frame 14 (FIG. 13). In the first embodiment, the sheet 40 is formed of polyester film, and its thickness is roughly in a range of 38-50 μm.

As described above, in the first embodiment, the problem that the toner having passed the gap between the cleaning edge 6*c* of the cleaning blade 6 and the end seal 30 leaks from the cleaning unit frame 14 can be prevented by capturing the toner with the toner trap 38.

As long as a cleaning unit is structured as the cleaning unit 13 in the first embodiment, even if it is necessary to increase the toner trap 48 in capacity because of the extended length of the service life of a cleaning unit, reduction in the toner particle diameter, and/or the like reason, it is unnecessary to increase in size the conventional auxiliary seal, and/or employ an auxiliary cleaning member to reduce the cleaning unit in the number of the areas through which the toner can pass. In other words, the present invention can prevent the toner removed from the peripheral surface of the photosensitive drum 1, from leaking from the cleaning unit, without increasing the cleaning unit in size.

Further, the second rib-like portion 37*b* of the vertical seal 37 is disposed on the downstream side of the nip between the cleaning blade 6 and photosensitive drum 1, and also, the nip between the end seal 30 and photosensitive drum 1, in terms of the rotational direction of the photosensitive drum 1. Therefore, the reaction force from the vertical seal 37 does not affect the end seal 30, and the elastic portion 6*a* of the cleaning blade 6. Therefore, the cleaning unit 13 in this embodiment is far smaller than any cleaning unit in accordance with the prior art, in terms of the amount by which the photosensitive drum 1 is frictionally worn by the end seal 30, and also, the amount by which the elastic portion 6*a* of the cleaning blade 6 is frictionally worn. That is, the present invention can easily increase a cleaning unit in the length of its service life.

Further, the vertical seal 37 is formed as an integral part of the cleaning unit frame 14 by injection molding. Therefore, the operation for bonding a soft seal to the cleaning unit frame 14 is unnecessary. In other words, the cleaning unit 13 in this embodiment is superior to any cleaning unit in accordance with the prior art, in terms of the efficiency with which a cleaning unit can be assembled. By the way, this embodiment is not intended to limit the present invention in scope. That is, the material and structure of the end seal 30, and those of the vertical seal 37, do not need to be limited to those in this embodiment; they should be changed as necessary.

In the first embodiment, the vertical seal 37 is formed, as an integral part of the cleaning unit frame, of an elastic substance by injection molding. More specifically, elastomer of thermoplastic styrene is used as the material for the vertical seal 37, and polystyrene resin is used as the material for the cleaning unit frame 14. These choices were made in consideration of the recyclability of the cleaning unit frame 14.

Embodiment 2

Figure 15:
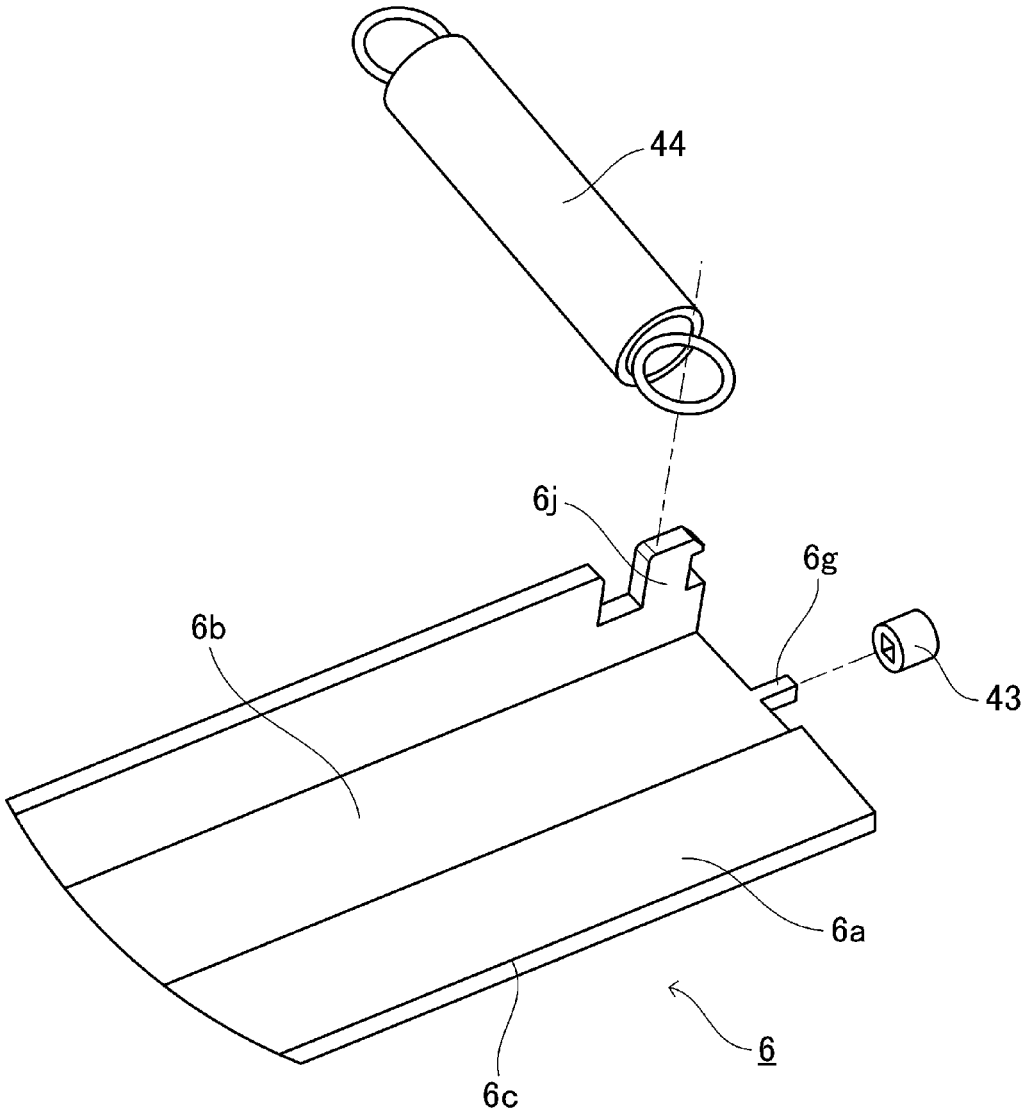
FIG. 15 is an exploded external perspective view of the cleaning blade in the second embodiment of the present invention.
Figure 16:
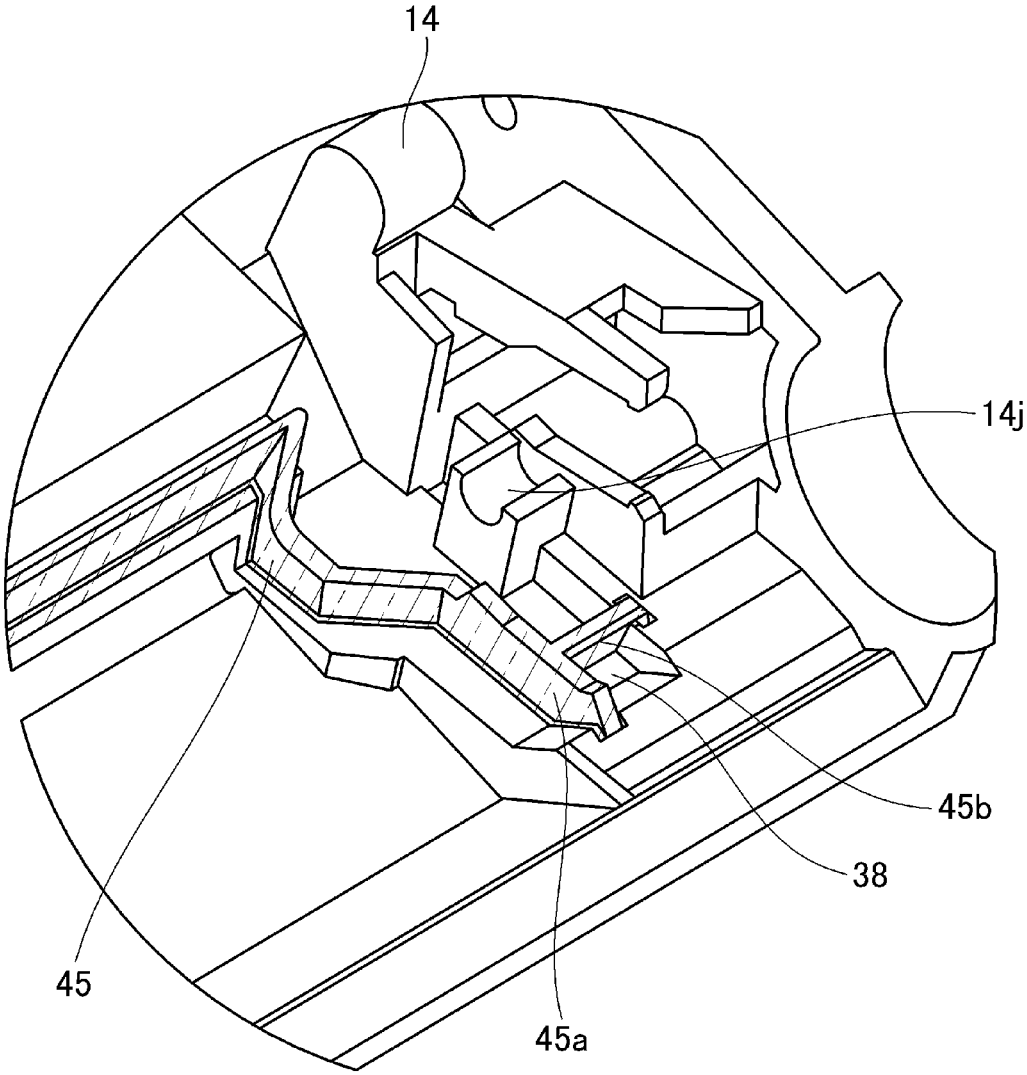
FIG. 16 is an enlarged perspective view of one of the lengthwise ends of the cleaning unit in the second embodiment, and shows the structural arrangement for keeping the cleaning unit sealed at the lengthwise ends of the cleaning unit immediately after the formation of the vertical seal.
Figure 17:
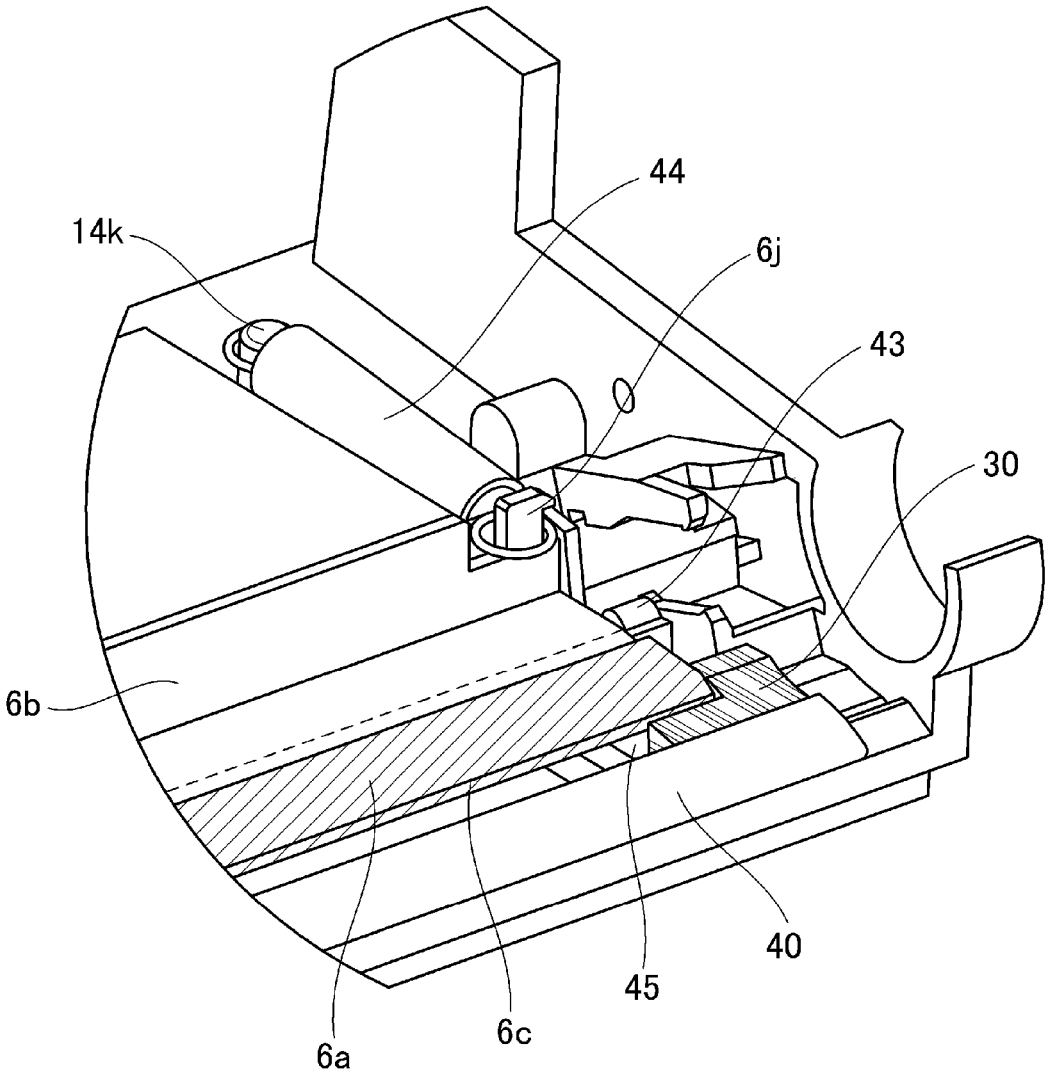
FIG. 17 is an enlarged perspective view of the one of the lengthwise ends of the cleaning unit in the second embodiment, and shows the state of the lengthwise end after the attachment of the cleaning blade and end seal to the cleaning unit frame.
Figure 18:
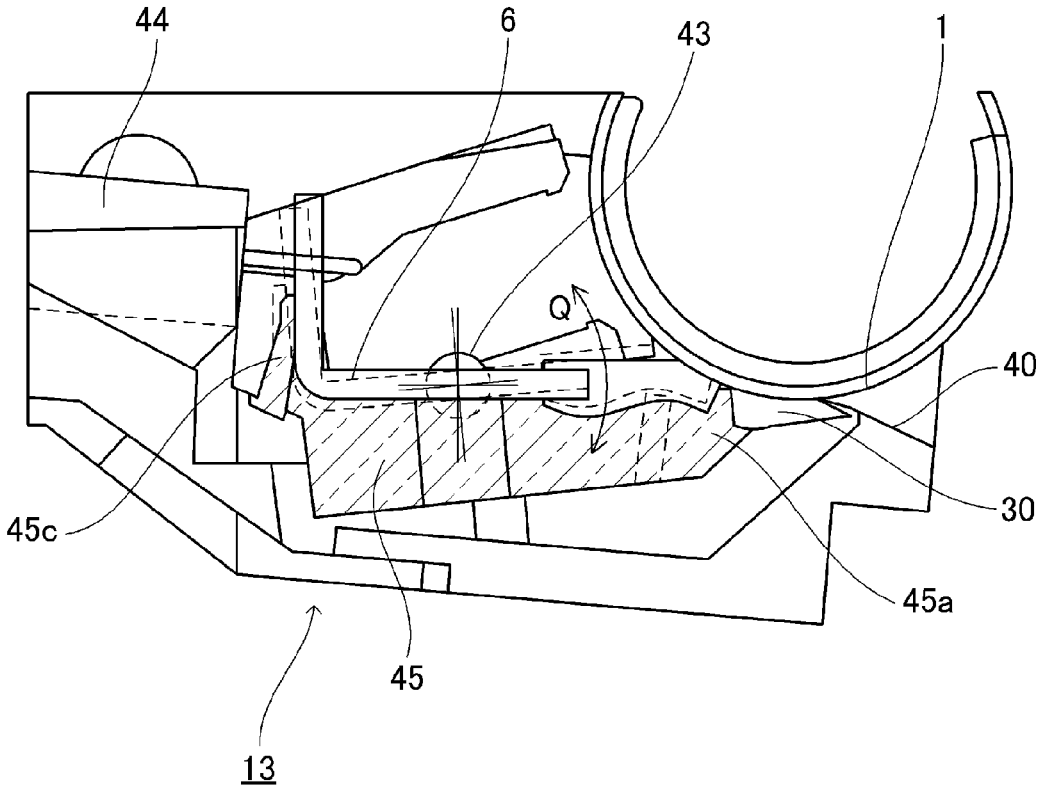
FIG. 18 is a schematic sectional view of the cleaning unit in the second embodiment, at a plane which coincides with the vertical seal, and shows the structural arrangement for keeping the cleaning unit sealed at its lengthwise ends.

Next, referring to FIGS. 15-18, the cleaning unit in the second embodiment of the present invention is described. FIG. 15 is an external perspective view of the cleaning blade in the second embodiment. FIG. 16 is a perspective view of one of the lengthwise end portions of the cleaning unit in the second embodiment, immediately after the formation of the vertical seal. It shows the structural arrangement for keeping sealed the cleaning unit at its lengthwise ends, in terms of toner leakage. FIG. 17 is a perspective view of the same lengthwise end portion of the cleaning unit in the second embodiment, as the one in FIG. 16, after the attachment of cleaning blade and end seal. It shows the structural arrangement for keeping sealed the cleaning unit at its lengthwise ends, in terms of toner leakage. FIG. 18 is a schematic sectional view of the cleaning unit in the second embodiment. It shows the structural arrangement for keeping the cleaning unit sealed at its lengthwise ends, and also, shows the behaviors of the cleaning blade and seals. The image forming apparatus, and its developing device, etc., in the second embodiment are the same in basic structure as the counterparts in the first embodiment. Thus, the components of the image forming apparatus in the second embodiment, which are the same in function and structure as the counterparts in the first embodiment, are given the same referential codes as those given to the counterparts in the first embodiment, and are not described in detail.

Referring to FIG. 15, in the second embodiment, the cleaning blade 6 is made up of an elastic portion 6*a* and a support portion 6*b*. The support portion 6*b* is provided with a protrusive portion 6*g* and a spring anchor portion 6*j*. The protrusive portion 6*g* protrudes from the lengthwise end of the support portion 6*b* in the lengthwise direction. The cleaning unit frame 14 is provided with a cleaning blade support 43, which is cylindrical and is fitted around the protrusive portion 6*g* of the cleaning blade 6. Thus, the cleaning blade 6 in this embodiment is supported by the support portion 6*b* so that it is allowed to rotationally move in an oscillatory manner. Next, referring to FIG. 16, the cleaning unit frame 14 is provided with a cleaning blade supporting portion 14*j*, with which the cleaning blade support 43 engages. Thus, the cleaning blade 6 is supported by the cleaning unit frame 14 so that it is allowed to rotationally move in an oscillatory manner. Further, an extension spring 44 as a tension (pressure) generating member, with which the cleaning unit 13 is provided, is engaged with the spring anchor portion 6*j* of the cleaning blade 6, and a boss 14*k* (FIG. 17), with which the cleaning unit frame 14 is provided. Thus, the cleaning blade 6 is kept pressed upon the peripheral surface of the photosensitive drum 1 by the tensile force of the extension spring 44.

In the second embodiment, the structural arrangement for keeping the area of contact between the cleaning blade 6 and cleaning unit frame 14 is as follows. Referring to FIG. 16, in the second embodiment, the cleaning unit frame 14 is provided with a seal 45, which was formed as if it is an integral part of the cleaning unit frame 14, by injection molding. This seal 45 may be considered as an integration of the vertical seal 37 as the first sealing member in the first embodiment, and the seal 42 for sealing the cleaning unit frame 14 at the lengthwise end portions in the first embodiment. The positional relationship between the seal 45 and cleaning blade 6, that is, the condition of the compression of the seal 45 by the cleaning blade 6, is set to be the same as that in the first embodiment. Further, the seal 45 in the second embodiment is made up of a first rib-like portion 45*a*, and a second rib-like portion 45*b* which extends from the first rib-like portion 45*a*.

The cleaning blade 6 is attached to the cleaning unit frame 14 so that it is supported by the blade support portion 14*j* of the cleaning unit frame 14. Then, the end seal 30 is attached to the cleaning unit frame 14. Thereafter, the sheet 40 shown in FIG. 18 is attached to the cleaning unit frame 14, and the photosensitive drum 1 is attached to the cleaning unit frame 14. Thus, as the photosensitive drum 1 is attached to the cleaning unit frame 14, not only is the cleaning unit 13 completed, but also, the cleaning unit 13 is satisfactorily sealed in terms of the prevention of the leak of the toner removed from the peripheral surface of the photosensitive drum 1.

Referring to FIG. 17, a structural arrangement, such as the one in the second embodiment, described above, can also make the first rib-like portion 45*a*, as the primary portion of the seal 45, airtightly contact the cleaning blade 6. Therefore, it can prevent the toner removed from the photosensitive drum 1 from leaking from the cleaning unit 13. Further, the problem that the removed toner leaks out of the cleaning unit 13 can be prevented by the toner trap 38 formed by the second rib-like portion 45*b*, end seal 30, cleaning blade 6, and cleaning unit frame 14, as it can in the first embodiment. Further, the second rib-like portion 45*b*, which is equivalent to the seal 42 in the first embodiment and extends lengthwise, airtightly contacts the support portion 6*b* of the cleaning blade 6, preventing thereby the removed toner from leaking.

Next, referring to FIG. 18, in the case of the cleaning unit 13, in the second embodiment, structured as described above, it sometimes occurs that due to the change in the state of the peripheral surface of the photosensitive drum 1, the cleaning blade 6 is rotationally moved in the direction indicated by an arrow mark Q about the axis of the blade supporting member 43, in the oscillatory manner. In such a case, the cleaning blade changes in position as indicated by a broken line in FIG. 18. On the other hand, the first and second rib-like portions 45*a* and 45*b* are in contact with the cleaning blade 6 and remains compressed by the cleaning blade 6. Therefore, as the cleaning blade 6 is moved, the first and second rib-like portions 45*a* and 45*b* follow the cleaning blade 6 while changing in shape. Therefore, no gap is created between the cleaning blade 6 and seal 45, ensuring that the removed toner is kept sealed in the cleaning unit 13.

Embodiment 3

Figure 19:
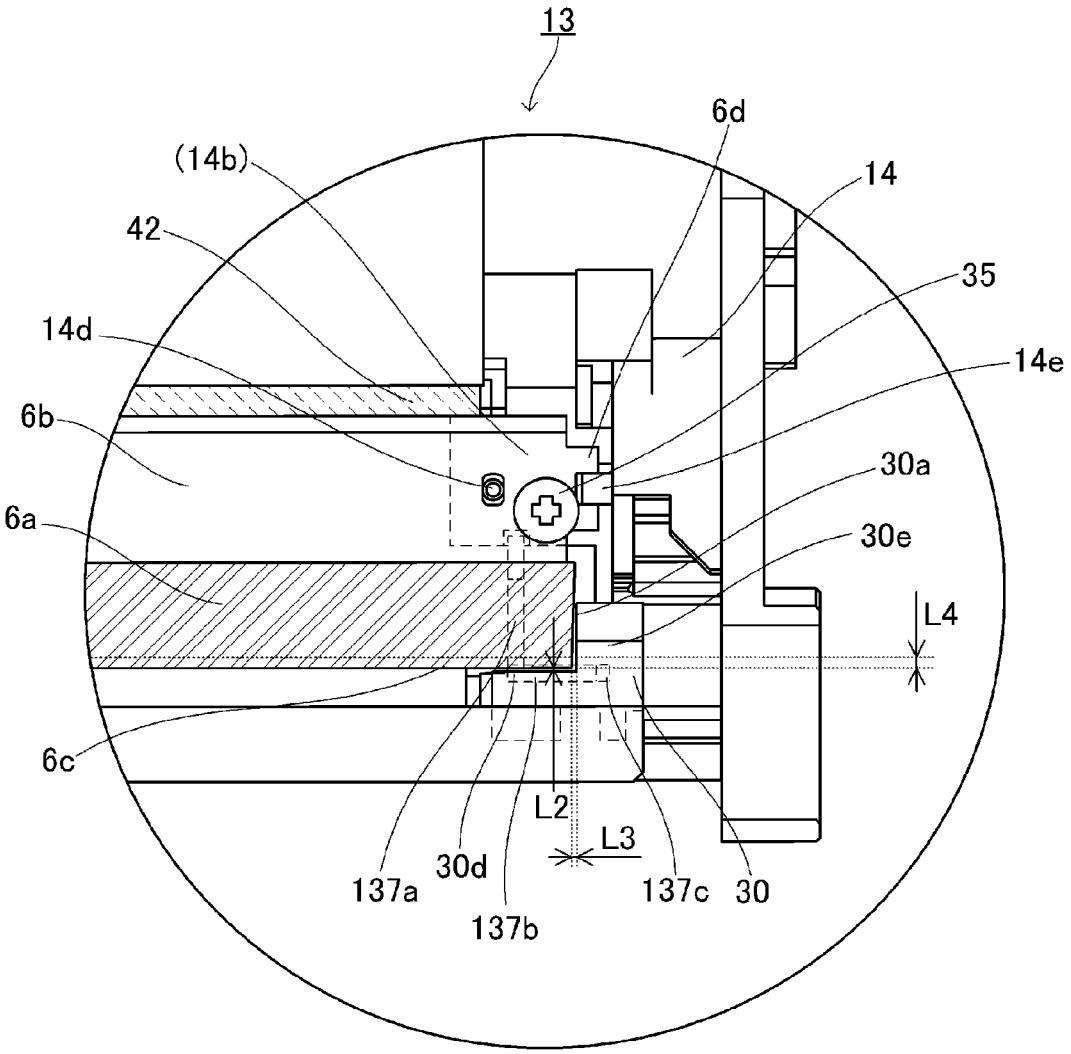
FIG. 19 is a drawing for describing the structural arrangement for keeping the cleaning unit sealed at the lengthwise ends of the cleaning unit, in the third embodiment of the present invention.
Figure 20:
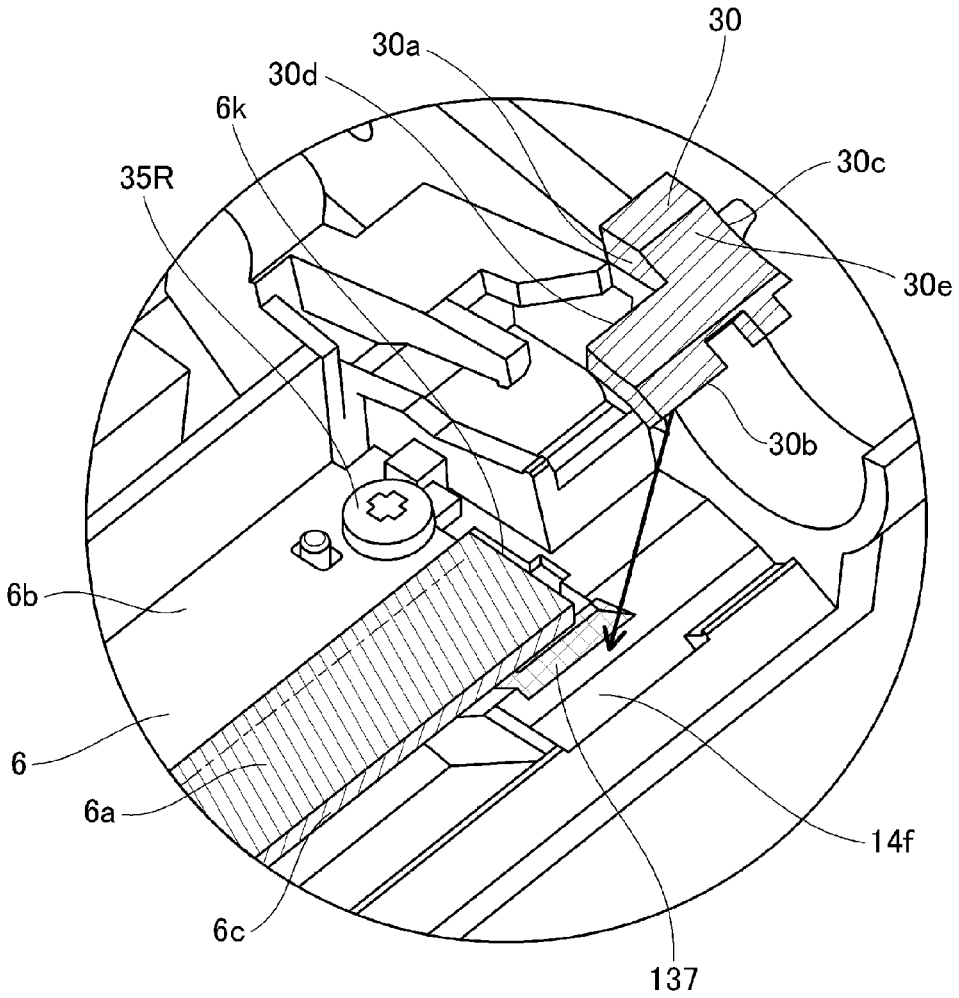
FIG. 20 is an enlarged perspective view of one of the lengthwise ends of the cleaning unit in the third embodiment, and shows the structural arrangement for keeping the cleaning unit sealed at the lengthwise ends of the cleaning unit.
Figure 21:
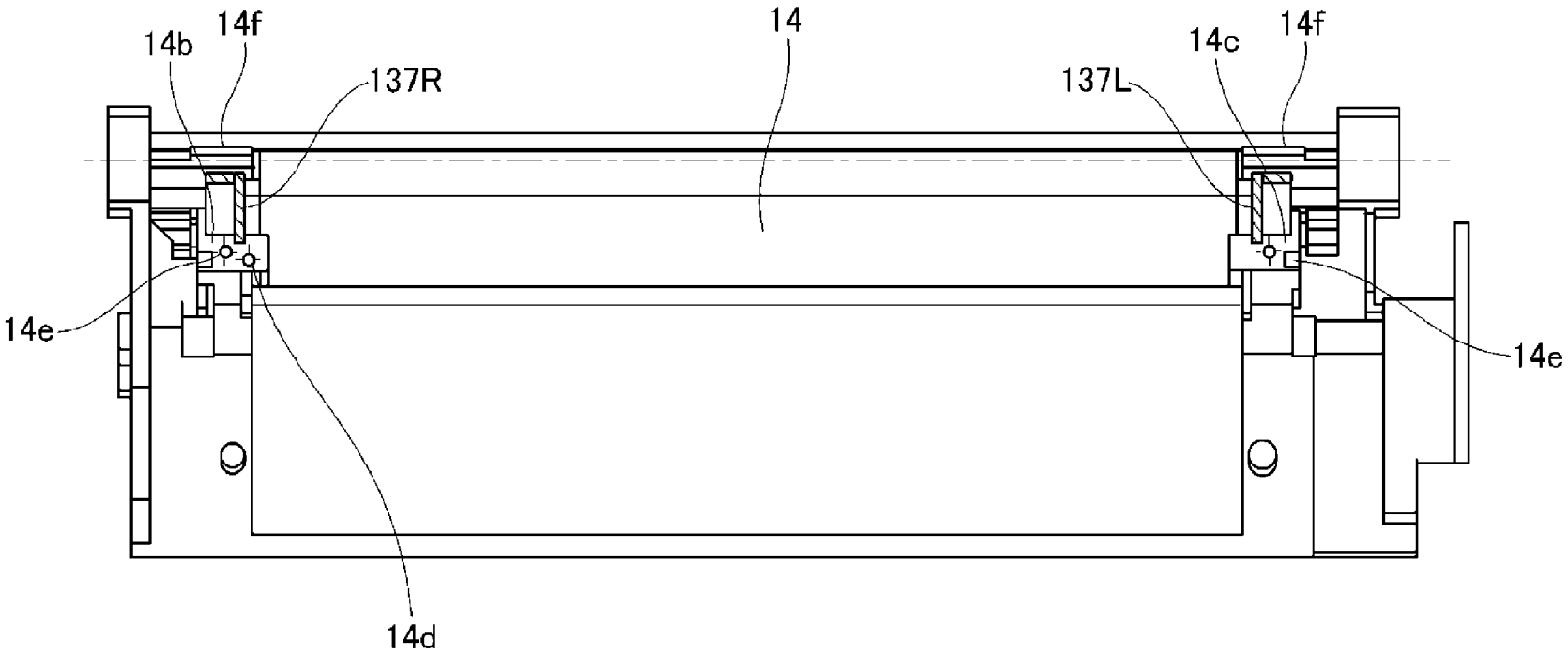
FIG. 21 is a plan view of the cleaning unit in the third embodiment, and shows the state of the cleaning unit immediately after the formation of the vertical seal.
Figure 22:
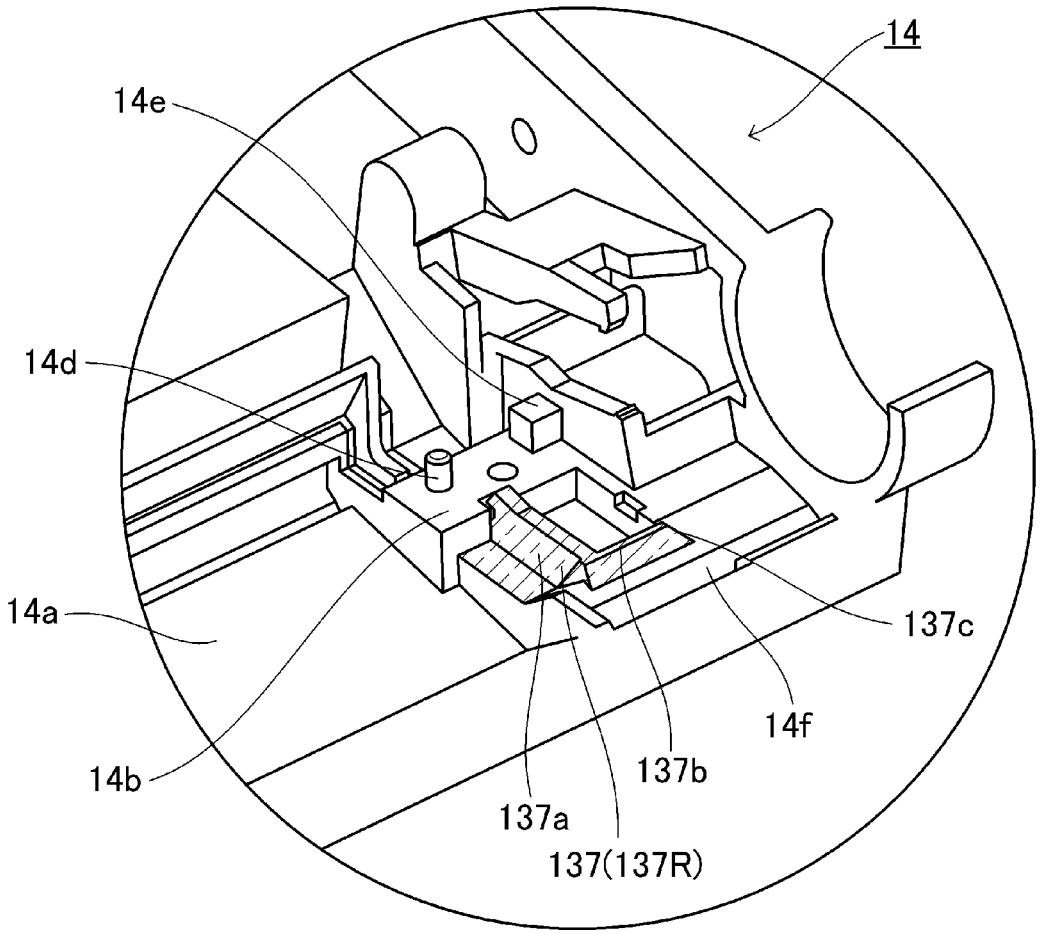
FIG. 22 is an enlarged perspective view of the vertical seal, and its adjacencies, in the third embodiment.
Figure 23:
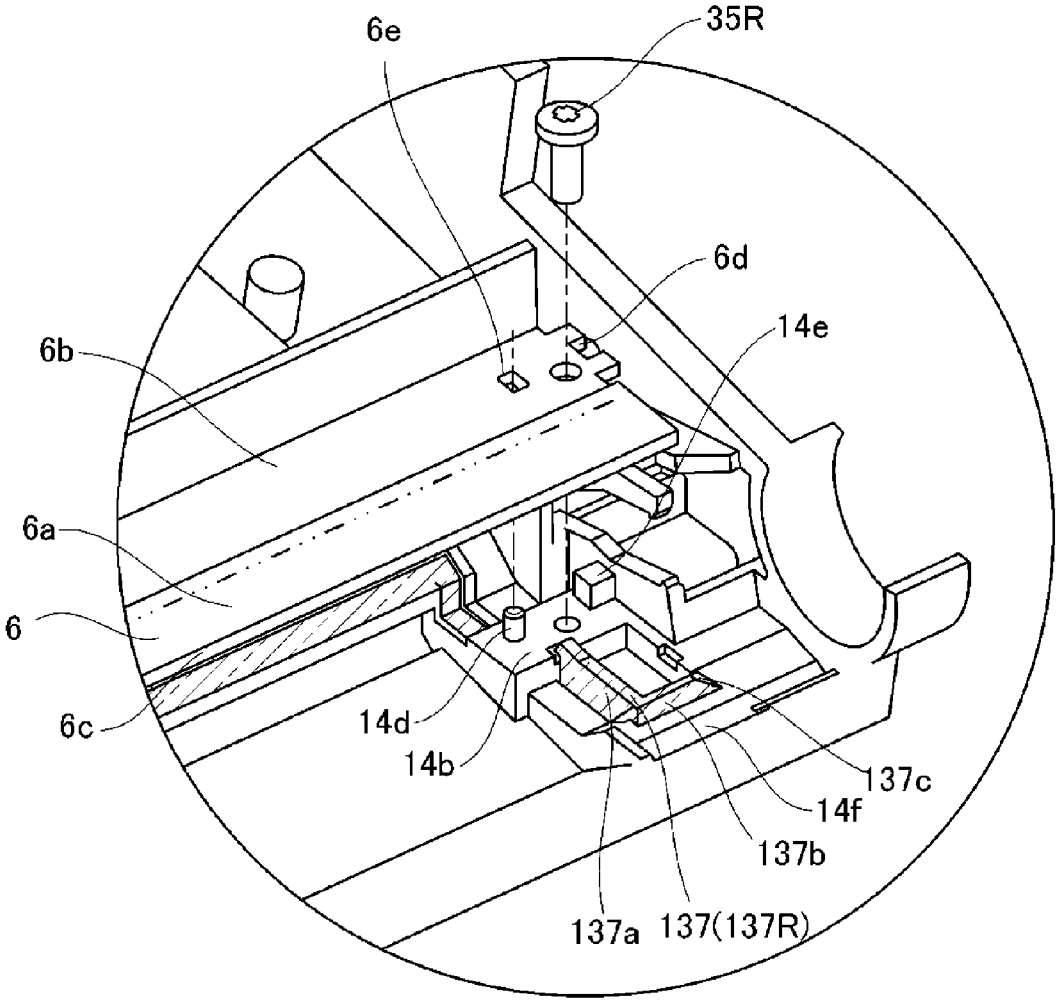
FIG. 23 is an enlarged perspective view of the one of the lengthwise ends of the cleaning unit in the third embodiment, and shows the state of the lengthwise end immediately prior to the attachment of the cleaning blade to the cleaning unit frame.
Figure 24:
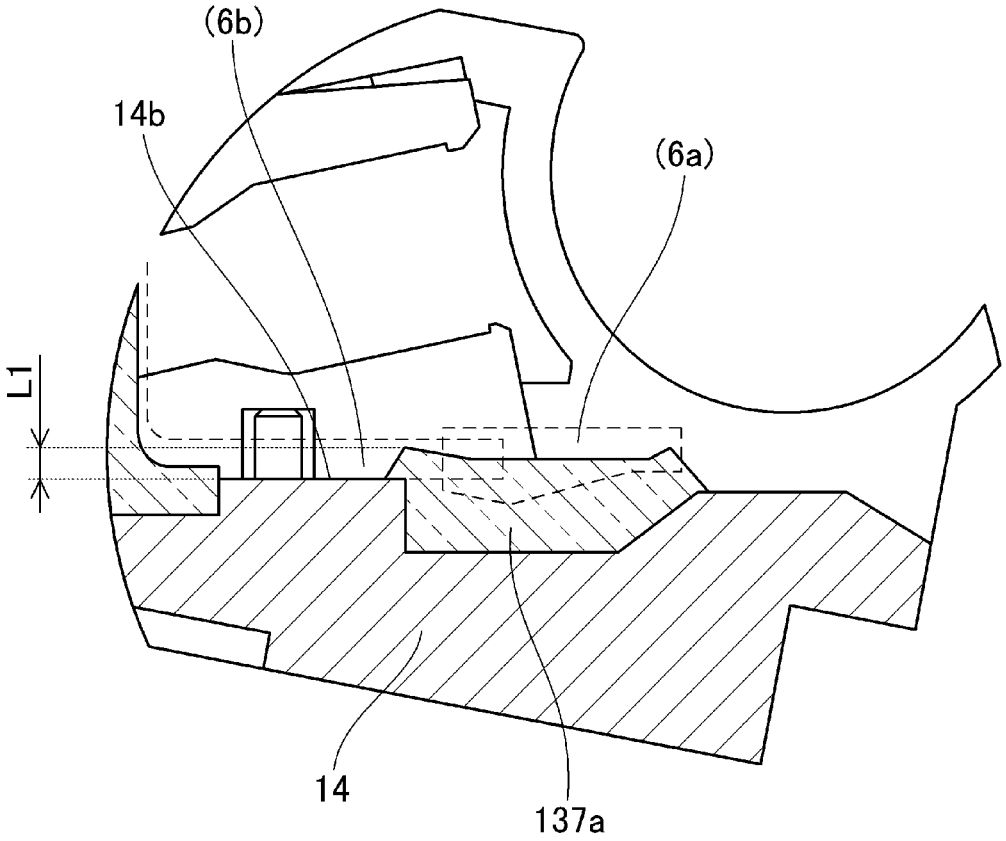
FIG. 24 is a schematic sectional view of the cleaning unit in the fourth embodiment, at a plane which coincides with the vertical seal.

Next, referring to FIGS. 19, and 20-24, the cleaning unit in the third embodiment of the present invention is described regarding its structural arrangement for keeping it sealed in terms of toner leakage. FIG. 19 is a plan view of one of the lengthwise end portions of the cleaning unit 13 in the third embodiment, and shows the structural arrangement of the cleaning unit 13 for keeping the cleaning unit sealed at its lengthwise ends. FIG. 20 is an enlarged perspective view of the same lengthwise end portion of the cleaning unit 13 as the one shown in FIG. 19, and shows the structural arrangement of the cleaning unit 13 for keeping the cleaning unit 13 sealed. FIG. 21 is a drawing of the cleaning unit frame 14 in the third embodiment immediately after the formation of the vertical seal. FIG. 22 is an enlarged perspective view of the vertical seal in the third embodiment. FIG. 24 is a schematic perspective view of the lengthwise end portion of the cleaning unit in the third embodiment, and shows how the cleaning blade is attached to the cleaning unit frame. Hereafter, the positional relationship among the vertical seal 137, cleaning blade 6, and end seal 30, and the structural arrangement for preventing the toner leakage, are described following the order in which these components are formed and/or attached to the cleaning unit frame 14. The image forming apparatus, and its developing device, etc., in the third embodiment are the same in basic structure as the counterparts in the first embodiment. Thus, the components of the image forming apparatus in the third embodiment, which are the same in function and structure as the counterparts in the first embodiment, are given the same referential codes as those given to the counterparts in the first embodiment, and are not described in detail.

<Vertical Seal>

Referring to FIG. 19, in the third embodiment, in order to prevent toner from leaking out of the cleaning unit frame 14, at the lengthwise ends of the cleaning blade 6, there is disposed the vertical seal 137 (as first sealing member) between the cleaning unit frame 14 and cleaning blade 6, remaining compressed by the cleaning unit frame 14 and cleaning blade 6. The vertical seal 137 is disposed at each of the lengthwise ends of the cleaning unit frame 14. Referring to FIG. 19, the vertical seal 137 is made up of the first and second rib-like portions 137*a* and 137*b*, respectively, which are molded together. The first rib-like portion 137*a*, as the base portion of the vertical seal 137, extends upstream from the cleaning blade seating surface 14*b* in terms of the rotational direction of the photosensitive drum 1. The second rib-like portion 137*b* (second extension) extends in the direction parallel to the axial line of the shaft of the photosensitive drum 1, through the gap between the cleaning edge 6*c* of the cleaning blade 6, and the end seal 30, so that its downstream end portion is compressed between the protrusion 30*e* of the end seal 30 and the cleaning unit frame 14, by the protrusion 30*e* and cleaning unit frame 14.

First, the vertical seal 137 is formed as an integral part of the cleaning unit frame 14 by injection molding. Then, the cleaning blade 6 is placed on the blade seating surface 14*b* of the cleaning unit frame 14 shown in FIGS. 22 and 23. Then, the cleaning blade 6 is fixed to the cleaning unit frame 14 with the small screws 35. Next, referring to FIG. 23, the cleaning unit frame 14 is provided with a boss 14*d* for precisely position the cleaning blade 6 relative to the cleaning unit frame 14 in terms of the lengthwise direction of the cleaning unit 13, whereas the supporting plate 6*b* of the cleaning blade 6 is provided with a hole 6*e*, which corresponds in position to the boss 14*d*. Also referring to FIG. 23, the cleaning unit frame 14 is provided with a square boss 14*e* for precisely positioning the cleaning blade 6 relative to the cleaning unit frame 14 in terms of the direction (widthwise direction) perpendicular to the lengthwise direction of the cleaning blade 6, whereas the cleaning blade 6 is provided with a recess 6*d* which corresponds in position to the square boss 14*e*.

Next, referring to FIG. 19, the vertical seal 137 is positioned so that it overlaps with the elastic portion 6*a* of the cleaning blade 6, at the lengthwise ends. Next, referring to FIG. 24, the vertical seal 137 is shaped so that after the attachment of the vertical seal 137 to the cleaning unit frame 14, its first rib-like portion 137*a* extends by a preset amount (distance L1 in FIG. 24) from the blade seating surface 14*b* of the cleaning unit frame 14 in the direction perpendicular to the surface 14*b*, and also, so that it will extend by a preset distance from the position (indicated by broken line in FIG. 24) in which its top surface will be after the attachment of the cleaning blade 6 to the cleaning unit frame 14. Therefore, as the cleaning blade 6 is attached to the cleaning unit frame 14, the first rib-like portion 137*a* of the vertical seal 137 is compressed by the elastic portion 6*a* of the cleaning blade 6, and the elastic portion supporting portion 6*b* of the cleaning blade 6, being made to airtightly contact the cleaning blade 6. Therefore, the toner removed from the peripheral surface of the photosensitive drum 1 is prevented from leaking out of the cleaning unit 13, through the area of contact between the cleaning blade 6 and vertical seal 137.

<End Seal>

As described above, the toner remaining on the peripheral surface of the photosensitive drum 1 after the primary transfer during an image forming operation is scraped away by cleaning edge 6*c* of the cleaning blade 6 disposed in the counter direction to the rotational direction of the photosensitive drum 1. Then, it is stored in the toner storage 14*a* for the removed toner. Thus, it is possible that the toner scraped away from the peripheral surface of the photosensitive drum 1 will leak from the cleaning unit 13 through the area of contact between each of the lengthwise ends of the photosensitive drum 1 and the cleaning unit frame 14. Therefore, cleaning unit 13 is provided with the pair of end seals 30, as shown in FIG. 19, which is for preventing the problem that the toner scraped away from the peripheral surface of the photosensitive drum 1 leaks from the cleaning unit 13 through the area of contact between each of the lengthwise ends of the photosensitive drum 1 and the cleaning unit frame 14.

The end seal 30 as the second sealing member is disposed at each of the lengthwise ends of the cleaning unit frame 14, so that it corresponds in position to the lengthwise end portions of the cleaning edge 6*c* of the cleaning blade 6, and also, so that it remains compressed between the photosensitive drum 1 and cleaning unit frame 14. The end seal 30 is provided with a protrusive portion 30*e* which is in the shape of a letter L, extending outward of the cleaning unit frame 14 beyond the lengthwise end surface 6*k* of the cleaning blade 6, and extending further from the cleaning edge portion of the cleaning blade 6 toward the base portion of the cleaning blade 6.

Next, referring to FIG. 20, the structure of the end seal 30 is described in detail. The above described protrusive portion 30*e* of the end seal 30 is provided with a lateral surface 30*a* for preventing the removed toner from leaking from the cleaning unit 13 at the lengthwise end surface 6*k* of the elastic portion 6*a* of the cleaning blade 6. Further, the rear side of the end seal 30 is provided with an adhesive layer 30*b* for bonding the end seal 30 to the cleaning unit frame 14. Further, the end seal 30 is provided with a surface 30*c* which contacts the peripheral surface of the photosensitive drum 1, and a surface 30*d* which is for preventing the removed toner from leaning from the cleaning unit 13 at the lengthwise end of the cleaning edge 6*c* of the cleaning blade 6.

The surface 30*c* of the end seal 30 is made up of an elastic substance such as piled fabric, felt, unwoven fabric, or the like. It contacts the peripheral surface of the photosensitive drum 1 in such a manner that it prevents the removed toner from leaking through the area of contact between itself and the peripheral surface of the photosensitive drum 1, while allowing the peripheral surface of the photosensitive drum 1 to slide on it. Incidentally, in some cases, the end seal 30 is provided with an intermediary layer, formed of foamed urethane or the like, for the adjustment of the contact pressure between the end seal 30 and photosensitive drum 1, in addition to the abovementioned layer, substances, etc. In the case of the end seal 30 in the third embodiment, its surface by which it contacts the peripheral surface of the photosensitive drum 1 is made up of piled fabric. Further, it is provided with the intermediary layer made of foamed urethane, and a piece of two-sided adhesive tape, as the adhesive layer 30*b*, for fixing the end seal 30 to the cleaning unit frame 14.

Next, referring to FIG. 20, the end seal 30 is adhered to the end seal seating surface 14*f* of the cleaning unit frame 14, in such a manner that a preset amount of gap (L2 in FIG. 19) is provided between the surface 30*d* of the end seal 30, and the cleaning edge 6*c* of the elastic portion 6*a* of the cleaning blade 6, which contacts the photosensitive drum 1. In the third embodiment, the amount of the gap L2 is set to be in a range of 0.1-0.5 mm. As the photosensitive drum 1 is attached to the cleaning unit frame 14, the elastic portion 6*a* of the cleaning blade 6, and the end seal 30, are deformed by the photosensitive drum 1, being thereby made to airtightly contact the peripheral surface of the photosensitive drum 1. The gap L2 is provided for preventing the problem that as the end seal 30 is compressed by the photosensitive drum 1, it runs onto the elastic portion 6*c* of the cleaning blade 6. As for the other surface 30*a* of the end seal 30, the end seal 30 is adhered to the cleaning unit frame 14 so that a preset amount of gap (L3 in FIG. 1) is provided between the surface 30*a* of the end seal 30 and the elastic portion 6*a* of the cleaning blade 6. In the third embodiment, the amount of the gap L3 is set to be in a range of 0-1.0 mm.

Next, the state of the cleaning unit 13 immediately after the attachment of the photosensitive drum 1 to the cleaning unit frame 14 is described. The photosensitive drum 1 is rotatably supported by the cleaning unit frame 14, with the placement of the drum bearings 39R and 39L between the lengthwise ends of the photosensitive drum 1, and the cleaning unit frame 14. As the photosensitive drum 1 is attached to the cleaning unit frame 14, the elastic portion 6*a* of the cleaning blade 6, and the end seal 30 are deformed by the photosensitive drum 1, being thereby made to airtightly contact the peripheral surface of the photosensitive drum 1. More specifically, the peripheral surface of the photosensitive drum 1 and the elastic portion 6*a* of the cleaning blade 6, come into contact with each other in such a manner that the area of contact (L4 in FIG. 1) between the peripheral surface of the photosensitive drum 1 and elastic portion 6*a*, in terms of the direction perpendicular to the lengthwise direction, has a preset width (L4 in FIG. 1). Thus, as the photosensitive drum 1 rotates, the cleaning blade 6 scrapes away the transfer residual toner on the peripheral surface of the photosensitive drum 1. That is, the end seal 30 can prevents the problem that as the photosensitive drum 1 rotates, the transfer residual toner on the peripheral surface of the photosensitive drum 1 is scraped away by the cleaning blade 6, and the removed toner leaks from the removed toner storage 14*a* of the cleaning unit frame 14. Further, the end seal 30 also airtightly contacts the peripheral surface of the photosensitive drum 1 by a preset width, in such a manner that as the photosensitive drum 1 rotates, the end seal 30 allows the peripheral surface of the photosensitive drum 1 slides on the end seal 30. Thus, the removed toner is prevented from leaking out of the cleaning unit 13.

(Characteristic Structural Features of Vertical Seal)

In the third embodiment, the second rib-like portion 137*b* of the vertical seal 137 is configured so that as it is compressed, it deforms. More specifically, as it is compressed, it deforms in such a manner that it comes into contact with the cleaning unit frame 14. Further, it is configured so that the downstream edge portion of the second rib-like portion 137*b*, in terms of the rotational direction of the photosensitive drum, is less in cross section than the rest. More concretely, referring to FIGS. 19, 22 and 22, in the third embodiment, the surface 137*c* of the second rib-like portion 137*b*, which contacts the protrusive portion 30*e* of the end seal 30, is angled to make the portion of the second rib-like portion 137*b*, which contacts the protrusive portion 30*e* of the end seal 30, gradually reduce in cross section toward its downstream edge.

As described above, as the second rib-like portion 137*b* of the vertical seal 137 is compressed, it deforms. Once the portion of the second rib-like portion 137*b*, which comes into contact with the cleaning unit frame 14 as the second rib-like portion 137*b* is compressed, comes into contact with the cleaning unit frame 14, it is not allowed to swell further in the direction in which it has swollen. Thus, it is forced to deform in the direction to press the end seal 30 upward. Thus, it is only near the portion of the second rib-like portion 137*b* that the end seal 30 is pressed upward. Therefore, it is possible that as the end seal 30 is changed in shape and/or attitude, it may not be able to keep sealed the area of contact between itself and photosensitive drum 1 as well as it can before it is changed in shape and/or attitude.

In the third embodiment, therefore, the portion of its second rib-like portion 137*b*, which contacts the end seal 30, is configured so that its surface by which it contacts the end seal 30 is angled as described above. Therefore, the contact pressure between the second rib-like portion 137*b* and end seal 30 is smaller than that in the preceding embodiments, by an amount proportional to the angle. In other words, the amount by which the end seal 30 is pressed upward by the downstream edge portion of the second rib-like portion 137*b* in the third embodiment is less than the amount by which the end seal 30 is pressed upward by the downstream edge portion of the second rib-like portion 37*b* in the preceding embodiments. That is, the provision of the tilted surface 137*c* makes the contact pressure between the second rib-like portion 137*b* and end seal 30, in terms of the rotational direction of the photosensitive drum 1, gradually reduce toward the downstream edge of the second rib-like portion 137*b*. Therefore, the changes in the shape and attitude of the end seal 30, which are attributable to the compression of the end seal 30, in the third embodiment is not as much as that in the preceding embodiment. That is, this embodiment is superior to the preceding embodiments in terms of the sealing between the photosensitive drum 1 and end seal 30.

As described above, the third embodiment is superior to the preceding embodiments, in terms of the sealing between the cleaning blade 6 and end seal 30, and also, the sealing between the photosensitive drum 1 and end seal 30.

Further, in the third embodiment, the surface 137*c* of the second rib-like portion 137*b* of the vertical seal 137, which contacts the protrusive portion 30*e* of the end seal 30 is tilted downward in terms of the rotational direction of the photosensitive drum 1. However, this embodiment is not intended to limit the present invention in scope in terms of the configuration of the second rib-like portion 137*b*. That is, the second rib-like portion 137*b* may be differently configured from the one in the third embodiment, as long as it is configured so that its downstream edge portion is less in cross section than the rest, that is, as long as the cleaning unit 13 is structured so that it is provided with a space into which the downstream end portion of the second rib-like portion 137*b*, in terms of the rotational direction of the photosensitive drum 1, is allowed to swell (extend) as it is compressed.

With a cleaning unit being structured like the cleaning unit 13 in the third embodiment, even if the increase in the service life of a cleaning unit, reduction in toner particle diameter, etc., make it necessary to better seal the cleaning unit in terms of toner leakage, it is unnecessary to increase in size the auxiliary seal, and/or provide the cleaning unit with an additional auxiliary cleaning member, in order to reduce the cleaning unit in the number of the areas through which toner is allowed to pass. That is, the third embodiment of the present invention can improve a cleaning unit in terms of the prevention of toner leakage, without increasing the cleaning unit in size. Further, the vertical seal 137 is formed as an integral part of the cleaning unit frame 14 by injection molding. Thus, the cleaning unit 13 in the third embodiment does not require the operation, which a cleaning unit in accordance with the prior art requires to adhere a soft sealing member to the frame of the cleaning unit. Therefore, it is superior to a cleaning unit in accordance with the prior art, in terms of the efficiency with which it can be assembled.

By the way, the preceding embodiments were described with reference to only one of the lengthwise end portions of the cleaning blade. However, the other end portion of the cleaning unit, that is, the end portion where the cleaning unit driving means is disposed, is the same in structure as the referential one. Further, the third embodiment is not intended to limit the present invention in scope in terms of the material and structure of the cleaning blade 6, end seal 30, and vertical seal 137. They are to be changed and/or modified as necessary.

In the third embodiment, the vertical seal 137 is formed, as an integral part of the cleaning unit frame 14, of an elastic substance, by injection molding. Further, it is an elastomer of thermoplastic styrene that is used as the material for the vertical seal 137, whereas it is polystyrene resin that is used as the material for the sealing unit frame 14. These materials are used in consideration of the recyclability of the cleaning unit 13.

Embodiment 4

Figure 25:
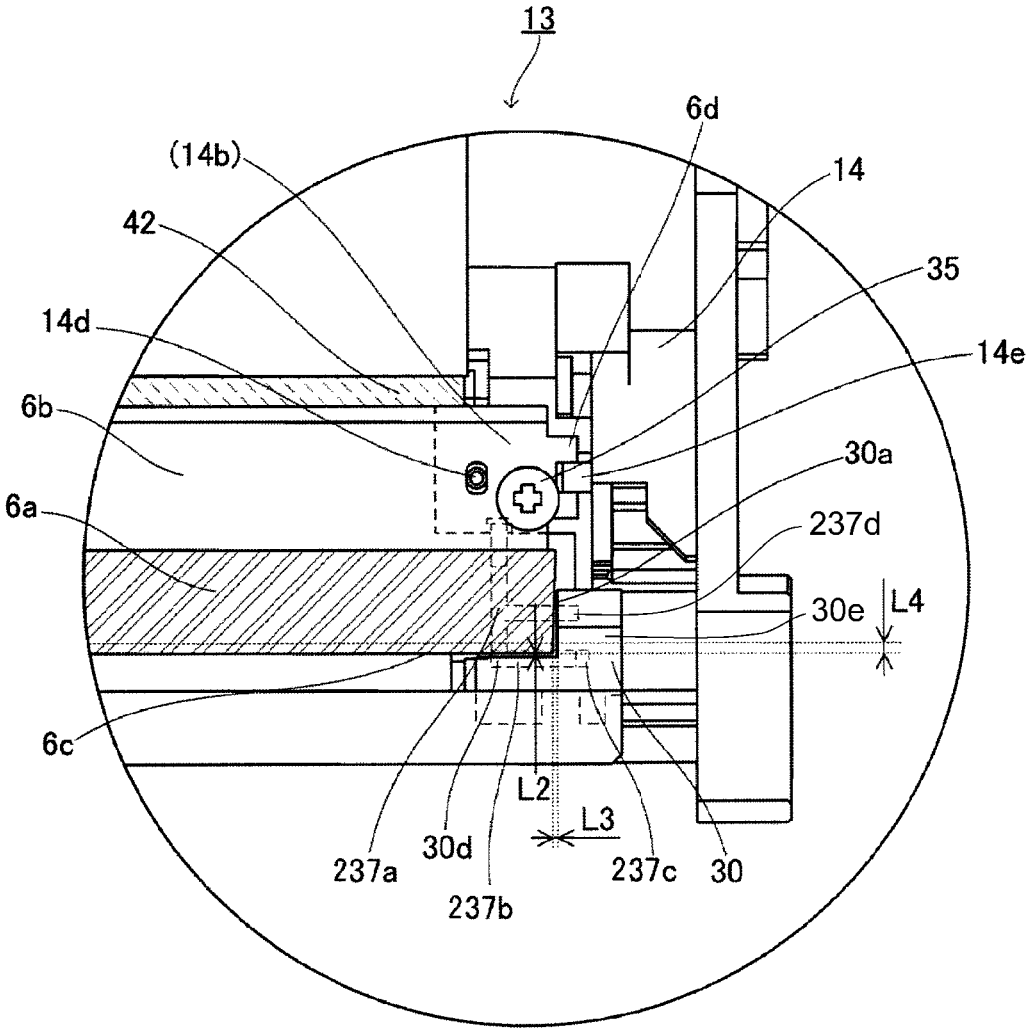
FIG. 25 is a drawing for describing the structural arrangement for keeping the cleaning unit sealed at the lengthwise ends of the cleaning unit, in the fourth embodiment of the present invention.
Figure 26:
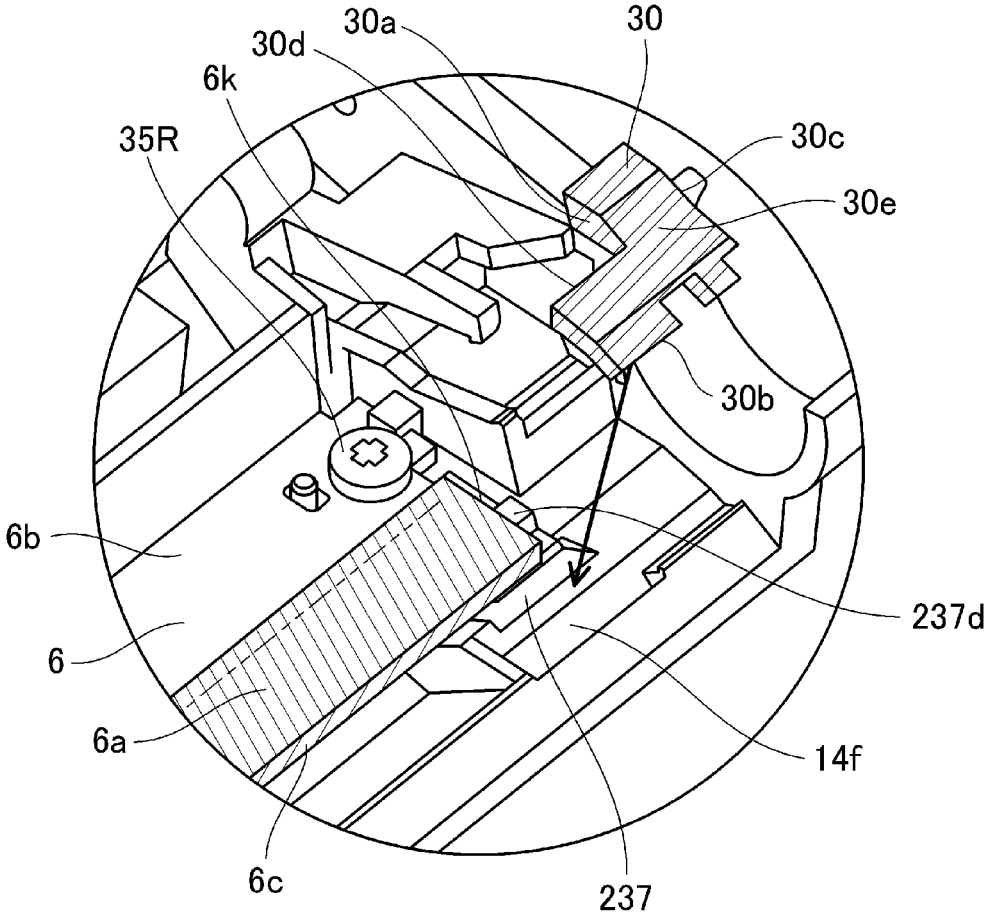
FIG. 26 is an enlarged perspective view of the cleaning unit in the fourth embodiment, and shows the structural arrangement for keeping the cleaning unit sealed at its lengthwise ends.
Figure 27:
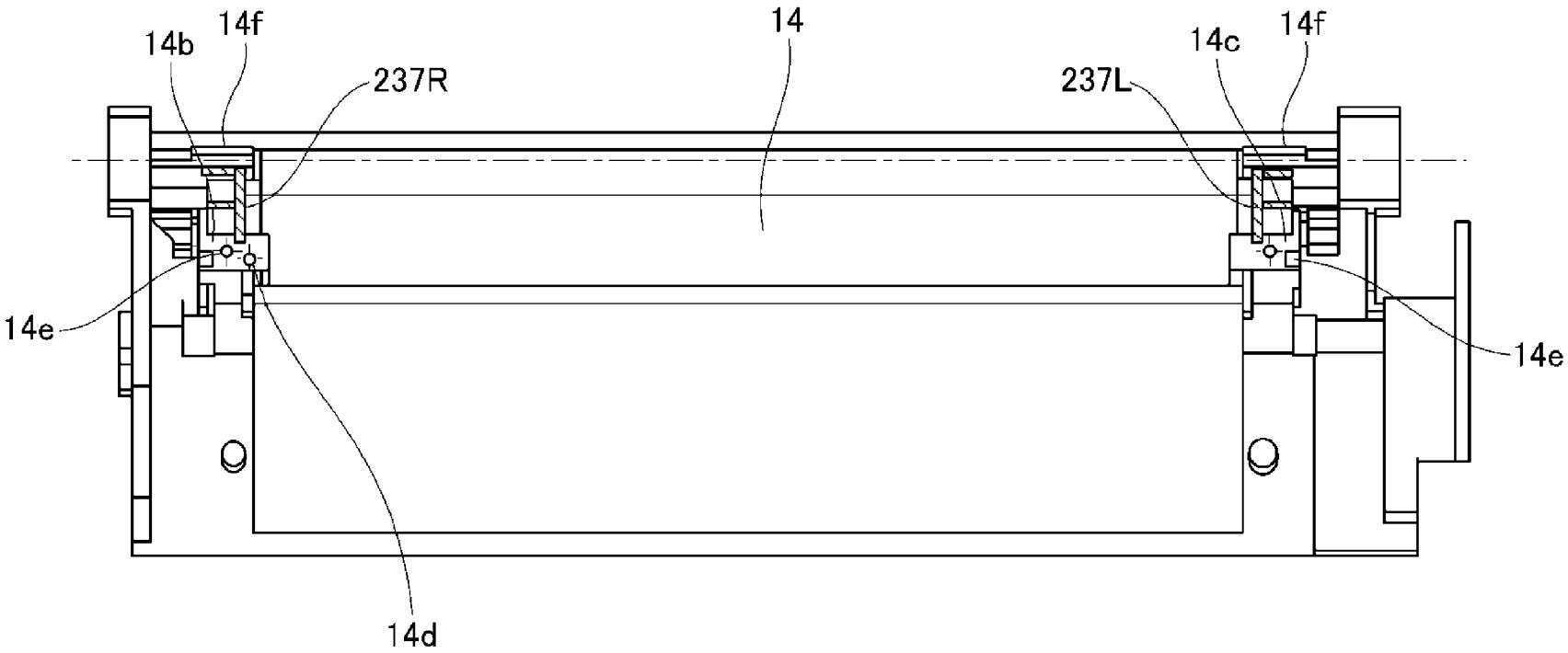
FIG. 27 is a plan view of the cleaning unit in the fourth embodiment, and shows the state of the cleaning unit immediately after the formation of the vertical seal.
Figure 28:
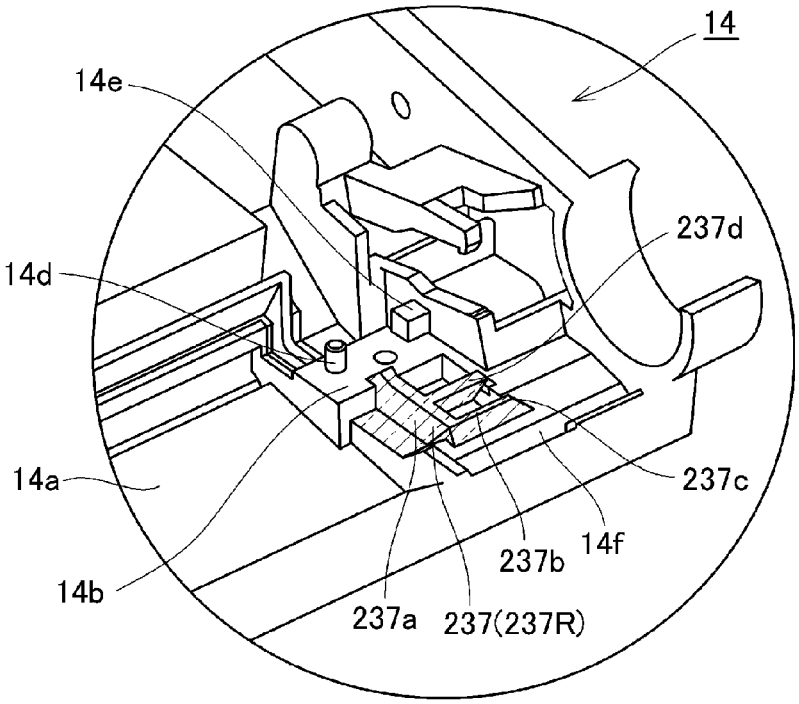
FIG. 28 is an enlarged perspective view of the vertical seal and its adjacencies in the fourth embodiment.
Figure 29:
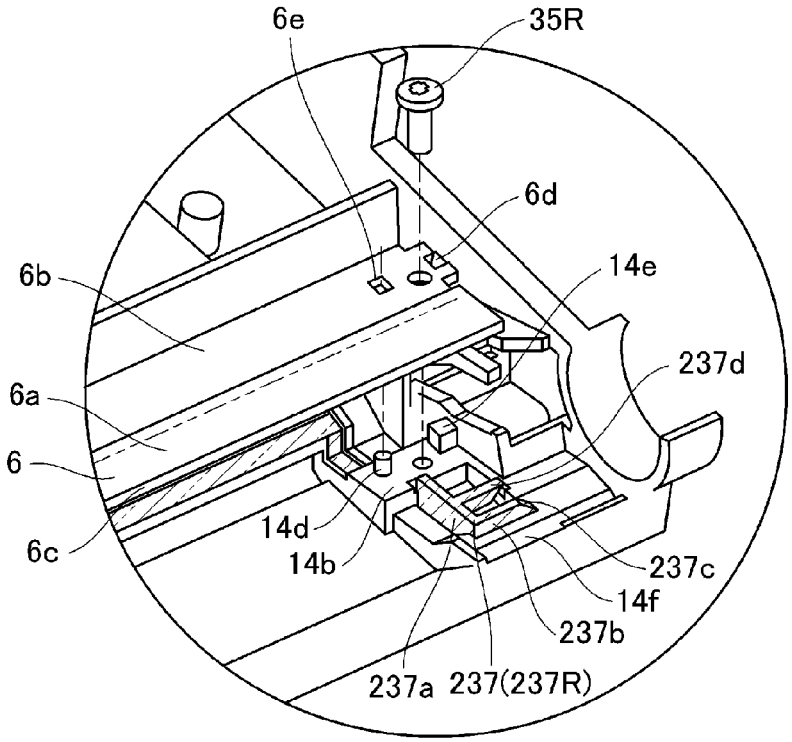
FIG. 29 is a perspective view of one of the lengthwise ends of the cleaning unit in the fourth embodiment, and shows how the cleaning blade is attached to the cleaning unit frame.
Figure 30:
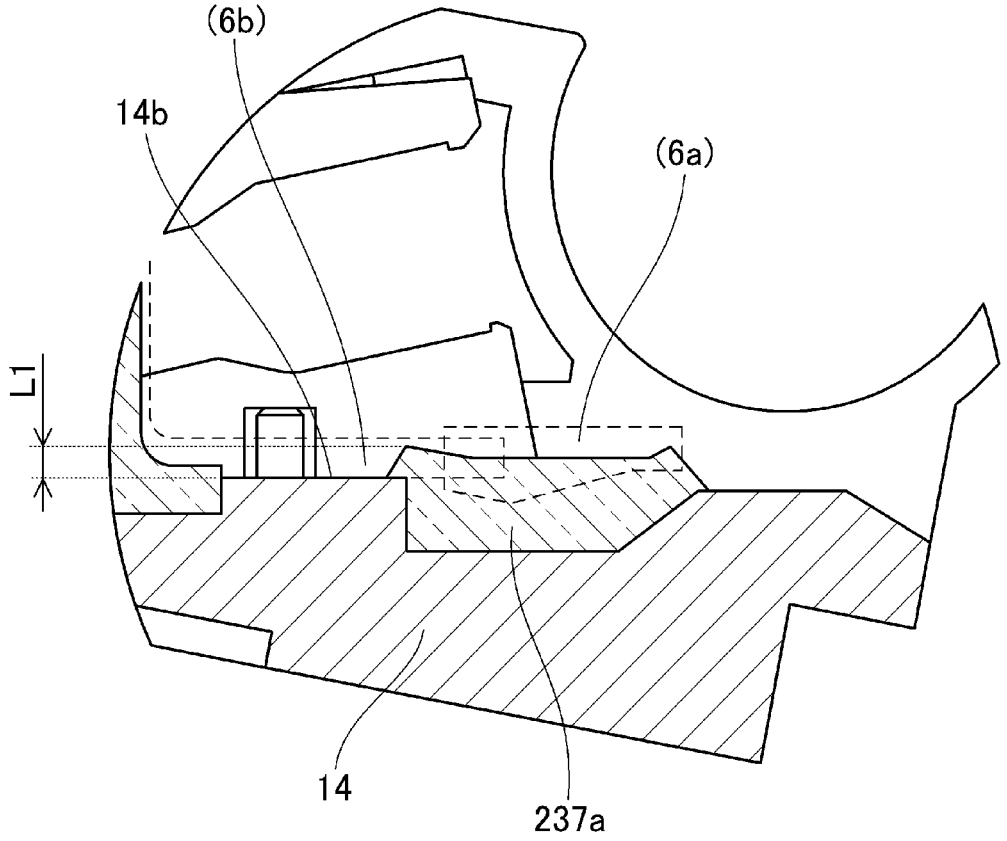
FIG. 30 is a schematic sectional view of the cleaning unit in the fourth embodiment, at a plane which coincides with the vertical seal of the cleaning unit.

Next, referring to FIGS. 25-30, the cleaning unit in the fourth embodiment of the present invention is described about its structural arrangement for keeping it sealed in terms of toner leakage. FIG. 25 is a drawing for describing the cleaning unit in the fourth embodiment about its structural arrangement for keeping it sealed at its lengthwise ends. FIG. 26 is an enlarged perspective view of one of the lengthwise end portions of the cleaning unit in the fourth embodiment, and shows its structural arrangement for keeping it sealed. FIG. 27 is a drawing of the cleaning unit in the fourth embodiment immediately after the formation of the vertical seal. FIG. 28 is an enlarged perspective view of the vertical seal in the fourth embodiment. FIG. 29 is an enlarged perspective view of one of the lengthwise end portions of the cleaning unit frame 14 in the fourth embodiment, which is for describing how the cleaning blade is attached to the cleaning unit frame 14. FIG. 30 is a schematic sectional view of the vertical seal in the fourth embodiment. Hereafter, the positional relationship among the vertical seal 237, cleaning blade 6, and end seal 30, and the structural arrangement for preventing the toner leakage, are described following the order in which these components are formed and/or attached to the cleaning unit frame 14. The image forming apparatus, and its developing device, etc., in the fourth embodiment are the same in basic structure as the counterparts in the first embodiment. Thus, the components of the image forming apparatus in the fourth embodiment, which are the same in function and structure as the counterparts in the first embodiment, are given the same referential codes as those given to the counterparts in the first embodiment, and are not described in detail.

<Vertical Seal>

Referring to FIG. 25, in the fourth embodiment, in order to prevent toner from leaking out of the cleaning unit frame 14, at the lengthwise ends of the cleaning blade 6, there is disposed the vertical seal 237 (as first sealing member) between the cleaning unit frame 14 and cleaning blade 6, remaining compressed by the cleaning unit frame 14 and cleaning blade 6. The vertical seal 237 is disposed at each of the lengthwise ends of the cleaning unit frame 14. Referring to FIG. 25, the vertical seal 237 is made up of the first and second rib-like portions 237*a* and 237*b*, respectively, which are molded together. The first rib-like portion 237*a*, as the base portion of the vertical seal 237, extends upstream from the cleaning blade seating surface 14*b* in terms of the rotational direction of the photosensitive drum 1. The second rib-like portion 237*b* (second extension) extends in the direction parallel to the axial line of the shaft of the photosensitive drum 1, through the gap between the cleaning edge 6*c* of the cleaning blade 6, and the end seal 30, so that its downstream edge portion is compressed between the protrusion 30*e* of the end seal 30 and the cleaning unit frame 14, by the protrusion 30*e* and cleaning unit frame 14. Next, referring to FIGS. 25, 28 and 29, the vertical seal 237 is configured so that the surface 237*c* of its second rib-like portion 237*b*, which contacts the protrusive portion 30*e* of the end seal 30, is tilted downward toward the downstream edge of the surface 237*c*, in terms of the rotational direction of the photosensitive drum 1, that is, the second rib-like portion 237*b* gradually reduces in cross section toward its downstream edge. That is, in terms of the direction perpendicular to the axial line of the photosensitive drum 1, the second rib-like portion 237*b* is the portion of the vertical seal 237, which extends in the direction parallel to the axial line of the photosensitive drum 1, from the point at which the first rib-like portion 237*a* contacts the cleaning edge 6*c*. Further, the vertical seal 237 has a third rib-like portion 237*d*, which is formed together with the first rib-like portion 237*a*, and extends in the direction parallel to the axial line of the photosensitive drum 1. The downstream edge portion of the third rib-like portion 237*d* seals the area of contact between the protrusive portion 30*e* and cleaning unit frame 14 by being compressed by the protrusive portion 30*e*. That is, the vertical seal 237 of the fourth embodiment is in the shape of an integrated combination of the vertical seal 37 in the first embodiment and the vertical seal 137 in the third embodiment. Therefore, it has the effects of the vertical seal 137 in the third embodiment, in addition to those of the vertical seal 37 in the first embodiment.

The vertical seal 237 is formed as an integral part of the cleaning unit frame 14, by injection molding. Next, cleaning blade 6 is placed on the cleaning blade seating surface 14*b* of the cleaning unit frame 14 shown in FIGS. 28 and 29, and is fixed to the cleaning unit frame 14 with a pair of small screws 35. Referring to FIG. 29, the cleaning unit frame 14 is provided with a boss 14*d* for precisely positioning the cleaning blade relative to the cleaning unit frame 14 in terms of the lengthwise direction, whereas the supporting plate 6*b* of the cleaning blade 6 is provided with a hole 6*e*, which corresponds in position to the boss 14*d*. Also referring to FIG. 29, the cleaning unit frame 14 is provided with a square boss 14*e* for precisely positioning the cleaning blade 16 relative to the cleaning unit frame 14 in terms of the direction (widthwise direction) perpendicular to the lengthwise direction of the cleaning blade 6. Further, the cleaning blade 6 is provided with a recess 6*d*, which corresponds in position to the square boss 14*e* of the cleaning unit frame 14.

Next, referring to FIG. 25, the vertical seal 237 is disposed so that it overlaps with the elastic portion 6*a* of the cleaning blade 6, at the lengthwise end portion of the cleaning blade 6. Referring to FIG. 30, the first rib-like portion 237*a* of the vertical seal 237 is configured so that as the vertical seal 237 is attached to the cleaning unit frame 14, it protrudes above the cleaning blade seating surface 14*b* of the cleaning unit frame by a preset amount (L1 in FIG. 30), and also, that as the cleaning blade 6 is attached to the cleaning unit frame 14, it will protrude by a preset amount from the position (indicated by broken line in FIG. 30), in which its top surface will be after the attachment of the cleaning blade 6. Thus, as the cleaning blade 6 is attached to the cleaning unit frame 14, the first rib-like portion 237*a* of the vertical seal 237 is compressed by the elastic portion 6*a* and supporting plate 6*b* of the cleaning blade 6, being thereby made to contact the cleaning blade 6 with no gap. Therefore, the toner removed from the peripheral surface of the photosensitive drum is prevented from leaking from the cleaning unit 13 through the area of contact between the cleaning blade 6 and vertical seal 237.

According to the present invention, it is possible to keep a cleaning unit reliably sealed, in terms of toner leakage, at the lengthwise ends of the cleaning blade, without complicating the cleaning unit in structure.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 214638/2012, 216922/2012 and 176753/2013 filed Sep. 27, 2012, Sep. 28, 2012 and Aug. 28, 2013, respectively, which are hereby incorporated by reference.

What is claimed is:

1. A cleaning unit for an image forming apparatus, the cleaning unit comprising:

a cleaning blade adapted to contact a rotatable image bearing member for removing developer from the image bearing member;

a frame that includes a developer accommodating portion for accommodating the developer removed by the cleaning blade;

a first sealing member sealing between the frame and the cleaning blade to prevent leakage of the developer from the developer accommodating portion; and a second sealing member sealing between the frame and the image bearing member to prevent leakage of the developer from the developer accommodating portion, the second sealing member being provided at a position opposing the cleaning blade in an axial direction of the image bearing member, wherein a gap is provided between the cleaning blade and the second sealing member in the axial direction, and wherein the first sealing member includes a rib extending in the axial direction, the rib (a) overlapping the gap in a stacking direction in which the frame, the first sealing member, and the cleaning blade are sequentially stacked, and (b) being compressed by the cleaning blade, the second sealing member, and the frame.

2. The cleaning unit according to claim 1, wherein the rib extends on a downstream side of the cleaning blade in a rotational moving direction of the image bearing member.

3. The cleaning unit according to claim 1, wherein an end portion of the rib has an inclined surface inclined with respect to the axial direction.

4. The cleaning unit according to claim 1, further comprising the image bearing member.

5. The cleaning unit according to claim 1, wherein the cleaning blade is rotatable relative to the frame.

6. The cleaning unit according to claim 1, wherein the gap is provided between the cleaning blade and the second sealing member in the axial direction, and the rib seals the gap.

7. The cleaning unit according to claim 1, wherein the second sealing member further includes a portion extending in the axial direction at a position contacting the cleaning blade.

8. The cleaning unit according to claim 1, wherein the first sealing member is provided by injection molding into the frame adjacent to an axial end portion of the image bearing member.

9. A process cartridge detachably mountable to a main assembly of an image forming apparatus, the process cartridge comprising:

a rotatable image bearing member;

a cleaning blade adapted to contact the image bearing member for removing developer from the image bearing member;

a frame that includes a developer accommodating portion for accommodating the developer removed by the cleaning blade;

a first sealing member sealing between the frame and the cleaning blade to prevent leakage of the developer from the developer accommodating portion; and a second sealing member sealing between the frame and the image bearing member to prevent leakage of the developer from the developer accommodating portion, the second sealing member being provided at a position opposing the cleaning blade in an axial direction of the image bearing member, wherein a gap is provided between the cleaning blade and the second sealing member in the axial direction, and wherein the first sealing member includes a rib extending in the axial direction, the rib (a) overlapping the gap in a stacking direction in which the frame, the first sealing member, and the cleaning blade are sequentially stacked, and (b) being compressed by the cleaning blade, the second sealing member, and the frame.

10. The process cartridge according to claim 9, wherein the rib extends in the axial direction on a downstream side of the cleaning blade in a rotational moving direction of the image bearing member.

11. The process cartridge according to claim 9, wherein an end portion of the rib has an inclined surface inclined with respect to the axial direction.

12. The process cartridge according to claim 9, wherein the cleaning blade is rotatable relative to the frame.

13. The process cartridge according to claim 9, wherein the gap is provided between the cleaning blade and the second sealing member in the axial direction, and the rib seals the gap.

14. The process cartridge according to claim 9, wherein the second sealing member further includes a portion extending in the axial direction at a position contacting the cleaning blade.

15. The process cartridge according to claim 9, wherein the first sealing member is provided by injection molding into the frame adjacent to an axial end portion of the image bearing member.

16. An image forming apparatus for forming an image on a recording material, the image forming apparatus comprising:

a rotatable image bearing member;

a cleaning blade adapted to contact the image bearing member for removing developer from the image bearing member;

a frame that includes a developer accommodating portion for accommodating the developer removed by the cleaning blade;

a first sealing member sealing between the frame and the cleaning blade to prevent leakage of the developer from the developer accommodating portion; and a second sealing member sealing between the frame and the image bearing member to prevent leakage of the developer from the developer accommodating portion, the second sealing member being provided at a position opposing the cleaning blade in an axial direction of the image bearing member, wherein a gap is provided between the cleaning blade and the second sealing member in the axial direction, and wherein the first sealing member includes a rib extending in the axial direction, the rib (a) overlapping the gap in a stacking direction in which the frame, the first sealing member, and the cleaning blade are sequentially stacked, and (b) being compressed by the cleaning blade, the second sealing member, and the frame.

* * * * *